US005124230A

United States Patent [19]

Okamura et al.

[11] Patent Number: 5,124,230

[45] Date of Patent: Jun. 23, 1992

[54] SILVER HALIDE PHOTOGRAPHIC MATERIAL

[75] Inventors: Hisashi Okamura; Kazunobu Katoh; Morio Yagihara, all of Kanagawa, Japan

[73] Assignee: Fuji Photo Film Co., Ltd., Kanagawa, Japan

[21] Appl. No.: 650,384

[22] Filed: Feb. 4, 1991

[30] Foreign Application Priority Data

Feb. 2, 1990 [JP] Japan ..... 2-24229
Feb. 5, 1990 [JP] Japan ..... 2-25501
Feb. 5, 1990 [JP] Japan ..... 2-25502

[51] Int. Cl.[5] ..... G03C 1/34
[52] U.S. Cl. ..... 430/264; 430/598
[58] Field of Search ..... 430/264, 598

[56] References Cited

U.S. PATENT DOCUMENTS 4,880,729 11/1989 Heki et al. ..... 430/598
4,912,016 3/1990 Machonkin et al. ..... 430/264
4,920,029 4/1990 Inoue et al. ..... 430/264
4,988,604 1/1991 Machonkin et al. ..... 430/264
5,006,445 4/1991 Yagihara et al. ..... 430/264

*Primary Examiner*—Richard L. Schilling
*Assistant Examiner*—Janet Baxter
*Attorney, Agent, or Firm*—Sughrue, Mion, Zinn, Macpeak & Seas

[57] ABSTRACT

The silver halide photographic material capable of providing very high contrast negative images is disclosed, which has at least one silver halide photographic emulsion layer on a support, wherein the silver halide photographic emulsion layer or another hydrophilic colloid layer provided on the support contains a nucleating agent represented by formula (Ia), (Ib) or (Ic):

$$R_{11}SCH_2CONH-Y_{11}-\overset{A_{11}}{\overset{|}{N}}-\overset{A_{12}}{\overset{|}{N}}-G_{11}-R_{12} \quad \text{(Ia)}$$

$$R_{21}SCH_2CONH-Y_{21}-\overset{A_{11}}{\overset{|}{N}}-\overset{A_{12}}{\overset{|}{N}}-\overset{O}{\overset{\|}{C}}-H \quad \text{(Ib)}$$

$$R_{31}SCH_2CONH-Y_{11}-\overset{A_{11}}{\overset{|}{N}}-\overset{A_{12}}{\overset{|}{N}}-\overset{O}{\overset{\|}{C}}H \quad \text{(Ic)}$$

wherein $R_{11}$, $R_{12}$, $R_{21}$, $R_{31}$, $Y_{11}$, $Y_{21}$, $A_{11}$, $A_{12}$ and $G_{11}$ are defined in the specification.

12 Claims, 1 Drawing Sheet

SILVER HALIDE PHOTOGRAPHIC MATERIAL

FIELD OF THE INVENTION

This invention relates to a silver halide photographic material giving very high-contrast negative images, highly-sensitive negative images, and good dot images, or to a silver halide photographic material forming direct positive photographic images. More particularly, the invention relates to a silver halide photographic material containing a novel compound as a nucleating agent for silver halide emulsions.

BACKGROUND OF THE INVENTION

It is known to add a hydrazine compound to a silver halide photographic material or to a developer as disclosed in U.S. Pat. No. 3,730,727 (a developer containing a combination of ascorbic acid and hydrazine), U.S. Pat. No. 3,227,552 (hydrazine is used as an auxiliary developing agent for obtaining a direct positive color image), U.S. Pat. No. 3,386,831 ($\beta$-mono-phenylhydrazine of an aliphatic carboxylic acid is contained as a stabilizer for a silver halide photographic material), and U.S. Pat. No. 2,419,975 and Mees, *The Theory of Photographic Process,* 3rd edition, page 281, (1966).

In particular, aforesaid U.S. Pat. No. 2,419,975 discloses a hard negative image obtained by the addition of a hydrazine compound. When a hydrazine compound is added to a silver chlorobromide emulsion layer and a photographic material having that emulsion layer is developed by a developer having a pH as high as 12.8, photographic characteristics having a very high contrast over 10 in gamma ($\gamma$) are obtained.

However, since a high alkaline developer having pH near 13 is likely to be air-oxidized and unstable, such a developer is not fit for storage or use for a long period of time.

Super high contrast photographic characteristics over 10 in gamma are very useful for photographic reproduction of continuous tone images by dot images (which is useful for printing plate making), or for reproduction of line images. For this purpose, a process of using a silver chlorobromide photographic emulsion having a silver chloride content over 50 mol%, preferably over 75 mol%, and developing the emulsion layer with a hydroquinone developer having a very low effective concentration of a sulfite ion (usually less than 0.1 mol/liter) has hitherto been used. However, in this process, the developer is very unstable due to the low sulfite ion concentration in the developer and cannot endure storage over 3 days.

Furthermore, in these processes, since a silver chlorobromide emulsion having a relatively high silver chloride content is required, a high sensitivity cannot be obtained. Accordingly, there has been a strong demand for super high contrast photographic characteristics useful for the reproduction of dot images and line images using a silver halide emulsion having a high sensitivity and a stable developer.

In U.S. Pat. Nos. 4,224,401, 4,168,977, 4,243,739, 4,272,614 and 4,323,643, silver halide photographic emulsions giving very high contrast negative photographic characteristics using a stable developer are disclosed, but it has been found that the acylhydrazine compounds used in the techniques disclosed in the aforesaid patents have various disadvantages.

It is known that these hydrazines generate a nitrogen gas during development. These gases gather in a photographic film to form bubbles to reduce the photographic images, and further the gases enter processing solutions where they have a bad influence on other photographic light-sensitive materials being processed with such processing solutions.

As a means for preventing the nucleating agent from coming into processing solutions, it has been known to increase the molecular weight of the nucleating agent alone a conventional molecular weight to render the nucleating agent non-diffusible. But it has been found that the conventional nucleating agent thus rendered non-diffusible has the problem in stability of the silver halide emulsion containing the nucleating agent with the passage of time. That is, when the coating composition containing the nucleating agent is stored for a long time, the nucleating agent is deposited in the coating composition, which reduces the filtering property and further changes the photographic performances.

Also, when these conventional hydrazines are used, a large amount is required to increase contrast. Further, when a specifically high sensitivity in regard to the performance of the photographic light-sensitive material is required, and when other sensitizing techniques (for example, increasing the chemical sensitivity, increasing the grain sizes, and the addition of a compound of accelerating the sensitivity as described in U.S. Pat. Nos. 4,272,606 and 4,241,164) are employed together, sensitivity sometimes increases and fog resulting from that sensitivity increase occurs during the storage of the photographic light-sensitive material.

Accordingly, a compound which can reduce the generation of the aforesaid bubbles, which does not come into a developer, which does not cause the aforesaid problem with stability with the passage of time, and which can give very high contrast photographic characteristics with the addition of a very small amount thereof, has been desired.

Also, in U.S. Pat. Nos. 4,385,108, 4,269,929, and 4,243,739, it is disclosed that a very high contrast negative photographic character is obtained by using hydrazines having a substituent easily adsorbable to silver halide grains. However, in the hydrazine compounds having the aforesaid adsorbable group, the specific compounds described in the aforesaid patents have the problem of causing a desensitization during the storage of the photographic light-sensitive material with the passage of time. Accordingly, it is necessary to discover hydrazine compounds which do not cause these problems.

On the other hand, although there are various direct positive photographic processes, the process of developing a photographic light-sensitive material containing previously fogged silver halide grains after light-exposing the silver halide grains in the existence of a desensitizing agent and the process of light-exposing a silver halide emulsion layer having sensitive specks mainly in the inside of the silver halide grains and then developing the emulsion layer in the presence of a nucleating agent are most useful. The present invention belongs to the latter process.

A silver halide emulsion containing sensitive specks mainly in the inside of the silver halide grains and forming a latent image mainly in the inside of the silver halide grains is called an internal latent image type silver halide emulsion. It can be discriminated from a silver halide emulsion containing silver halide grains forming a latent image mainly on the surface of the silver halide grains.

A process of obtaining direct positive images by surface developing the internal latent image type silver halide emulsion in the presence of a nucleating agent and also the photographic emulsions and photographic light-sensitive materials which are used for the process are known.

In the aforesaid process of obtaining the direct positive images, a nucleating agent may exist in the developer. But when the nucleating agent is adsorbed on the surface of silver halide grains by incorporating the agent in a silver halide photographic emulsion layer or other suitable layer of a photographic light-sensitive material, better reversal characteristics can be obtained.

As a nucleating agent which is used for the aforesaid process of obtaining direct positive images, there are known hydrazines described in U.S. Pat. Nos. 2,563,785 and 2,588,982; hydrazide and hydrazine series compounds described in U.S. Pat. No. 3,227,552; heterocyclic quaternary salt compounds described in U.S. Patents 3,615,615, 3,719,494, 3,734,738, 4,094,683, and 4,115,122, British Patent 1,283,835, JP-A-52-3426, JP-A-52-69613 (the term "JP-A" as used herein means an "unexamined published Japanese patent application"); thiourea bonded type acylphenylhydrazine series compounds described in U.S. Pat. Nos. 4,030,925, 4,031,127, 4,139,387, 4,245,037, 4,255,511, and 4,276,364 and in British Patent 2,012,443; compounds having a heterocyclic thioamide as an adsorbing group described in U.S. Pat. No. 4,080,207; phenylacylhydrazine compounds having a heterocyclic group having a mercapto group as an adsorbing group described in British Patent 2,011,397B; sensitizing dyes having a substituent having a nucleating action in the molecular structure described in U.S. Pat. No. 3,718,470; and hydrazine compounds described in JP-A-59-200230, JP-A-59-212828, and JP-A-59-212829, and Research Disclosure, No. 25310 (Nov., 1953).

However, it has been found that these nucleating agents for obtaining high contrast negative or positive images have insufficient nucleating activity. The nucleating agents having a high activity are insufficient in storage stability, and the activity thereof deviates after being added to a silver halide emulsion to coating. And when various kinds of nucleating agents are added, the quality of the emulsion layer is reduced.

For solving these faults, other nucleating agents are proposed in JP-A-60-179734, JP-A-61-170733, JP-A-61-270744, JP-A-62-65034, JP-A-62-948, JP-A-63-223744, JP-A-63-234244, JP-A-3-234245, JP-A-63-234246, JP-A-63-306438, and JP-A-1-10233, and European Patent Publication (unexamined) 345,025.

However, to lower pH of a developer for increasing the stability of the developer (i.e., preventing the deterioration of a developing agent), to shorten the processing time of development, or to reduce the reliance on changing of the developer (e.g., pH and sodium sulfite), nucleating agents having a more higher nucleating activity have been desired.

SUMMARY OF THE INVENTION

A first object of this invention is to provide a silver halide photographic material capable of obtaining very high contrast negative photographic characteristics over 10 in gamma using a stable developer.

A second object of this invention is to provide a negative working silver halide photographic material containing a novel highly-active hydrazine capable of giving desired very high contrast negative tone photographic characteristics even when using a small amount thereof and a developer of low pH, without causing a bad influence on the photographic characteristics.

A third object of this invention is to provide a direct positive type silver halide photographic material containing a novel highly-active hydrazine capable of giving excellent reversal characteristics even with a developer having a low pH.

A fourth object of this invention is to provide a silver halide photographic material having a stability with the passage of time and containing a novel highly-active hydrazine which can be easily synthesized and is excellent in storage stability.

A fifth object of this invention is to provide a silver halide photographic material in which the silver halide emulsion has good stability with the passage of time and the deviation of activity at the production of the photographic light-sensitive material is less.

A sixth object of this invention is to provide a silver halide photographic material having less reliability upon the composition of the developer.

It has now been discovered that the aforesaid and other objects can be attained by the present invention as set forth hereinbelow.

The invention provides a silver halide photographic material having at least one silver halide photographic emulsion layer on a support, wherein the silver halide photographic emulsion layer or at least one other hydrophilic colloid layer contains at least one compound represented by formula (I*a*), (I*b*) or (I*c*).

$$R_{11}SCH_2CONH-Y_{11}-\overset{A_{11}}{\overset{|}{N}}-\overset{A_{12}}{\overset{|}{N}}-G_{11}-R_{12} \qquad \text{(Ia)}$$

wherein $R_{11}$ represents an aliphatic group or an aromatic group, $R_{12}$ represents an alkyl group, an aryl group, an alkoxy group, an aryloxy group, an amino group, a hydrazino group, a carbamoyl group, or an oxycarbonyl group, $G_{11}$ represents $$-\overset{O}{\overset{\|}{C}}-,\ -SO_2-,\ -SO-,\ -\overset{O}{\overset{\|}{\underset{\underset{R_{12}}{|}}{P}}}-,$$

a thiocarbonyl group, or an iminomethylene group, $A_{11}$ and $A_{12}$ both represent a hydrogen atom, or one of them represents a hydrogen atom and the other represents a sulfonyl group or an acyl group, and $Y_{11}$ represents a divalent organic group;

$$R_{21}SCH_2CONH-Y_{21}-\overset{A_{11}}{\overset{|}{N}}-\overset{A_{12}}{\overset{|}{N}}-\overset{O}{\overset{\|}{C}}-H \qquad \text{(Ib)}$$

wherein $R_{21}$ represents an aliphatic group, $Y_{21}$ represents a divalent heterocyclic group, and $A_{11}$ and $A_{12}$ have the same meanings as in formula (Ia);

$$R_{31}SCH_2CONH-Y_{11}-\overset{A_{11}}{\overset{|}{N}}-\overset{A_{12}}{\overset{|}{N}}-\overset{O}{\overset{\|}{C}}-H \qquad \text{(Ic)}$$

wherein $R_{31}$ represents an aromatic group or a heterocyclic group, and $A_{11}$, $A_{12}$ and $Y_{11}$ have the same meanings as in formula (I*a*).

Figure 1A:
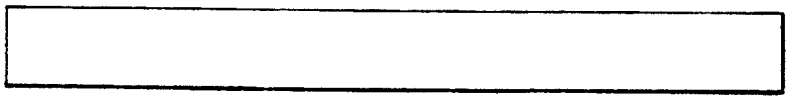
FIG. 1 is a schematic view showing the construction at light-exposure for forming an image of white lettering on a solid background (or super-imposed letter) by contact work; The marks are as follows.

(a): transparent or translucent base;

(b): line image original (in addition, the black portions show line images);

(c): transparent or translucent base;

(d): dot image original (in addition, black portions show dots); and (e): photographic light-sensitive material for contact work (in addition, the oblique line portion shows a light-sensitive emulsion layer).

DETAILED DESCRIPTION OF THE INVENTION

The compounds shown by formulae (Ia), (Ib) and (I*c*) are now explained in greater detail.

In formulae (I*a*) and (I*b*), the aliphatic group shown by $R_{11}$ and $R_{21}$ preferably has from 1 to 30 carbon atoms, and is particularly preferably a straight chain, branched, or cyclic alkyl group having from 1 to 20 carbon atoms. In this case, the branched alkyl group may be cyclized such that a saturated heterocyclic ring having one or more hetero atoms is formed therein.

The aromatic group shown by $R_{11}$ and $R_{31}$ is a monocyclic or dicyclic aryl group such as a phenyl group, a naphthyl group, etc.

The heterocyclic group shown by $R_{31}$ is a 3- to 10-membered saturated or unsaturated heterocyclic ring containing at least one nitrogen, oxygen or sulfur atom. The heterocyclic ring may be a monocyclic ring or may form a condensed ring with an aromatic ring or an other heterocyclic ring.

The heterocyclic ring is preferably a 5- or 6-membered aromatic heterocyclic ring, and examples thereof include a pyridine ring, an imidazolyl group, a quinolinyl group, a benzimidazolyl group, a pyrimidyl group, a pyrazolyl group, an isoquinolinyl group, a benzothiazolyl group, and a thiazolyl group.

Each of the groups shown by $R_{11}$, $R_{21}$ and $R_{31}$ may be substituted one or more of the following substituents, which may be further substituted: an alkyl group, an aralkyl group, an alkenyl group, an alkynyl group, an alkoxy group, an aryl group, a substituted amino group (e.g., acylamino and sulfonylamino), a ureido group, a urethane group, an aryloxy group, a sulfamoyl group, carbamoyl group, an alkylthio group, an arylthio group, an alkylsulfonyl group, an arylsulfonyl group, an alkylsylfinyl group, an arylsulfinyl group, a hydroxy group, a halogen atom, a cyano group, a sulfo group, an aryloxycarbonyl group, an acyl group, an alkoxycarbonyl group, an acyloxy group, a carbonamido group, a sulfonamido group, a carboxy group, a phosphoric acid amido group, a diacylamino group, an imido group, and $$R_{12}-NH\underset{\underset{R_{12}}{|}}{C}N-\overset{\overset{O}{\|}}{C}-\overset{\overset{O}{\|}}{}$$

(wherein $R_{12}$ has the same meanings as defined in formula (I*a*))

Preferred substituents are a straight chain, branched or cyclic alkyl group (preferably having from 1 to 20 carbon atoms), an aralkyl group (preferably, the alkyl moiety is a monocyclic or dicyclic alkyl group having from 1 to 3 carbon atoms), an alkoxy group (preferably having from 1 to 20 carbon atoms), a substituted amino group (preferably an amino group substituted by an alkyl group having from 1 to 20 carbon atoms), an acylamino group (preferably having from 2 to 30 carbon atoms), a sulfonamido group (preferably having from 1 to 30 carbon atoms), a ureido group (preferably having from 1 to 30 carbon atoms), and a phosphoric acid amido group (preferably having from 1 to 30 carbon atoms).

The alkyl group shown by $R_{12}$ in formula (I*a*) is preferably an alkyl group having from 1 to 4 carbon atoms and may have a substituent such as a halogen atom, a hydroxy group, a cyano group, a carboxy group, a sulfo group, an alkoxy group, a phenyl group, an acyl group, an alkoxycarbonyl group, an aryloxycarbonyl group, a carbamoyl group, an alkylsulfonyl group, an arylsulfonyl group, a sulfamoyl group, a nitro group, a heterocyclic aromatic ring group, $$R_{11}-\underset{\underset{A_{11}}{|}}{N}-\underset{\underset{A_{12}}{|}}{N}-G_{11}-,$$

etc.

Also, the aforesaid substituents may be further substituted.

The aryl group shown by $R_{12}$ is preferably a monocyclic or dicyclic aryl group including, for example, a benzene ring or a naphthyl group. The aryl group may be substituted by the substituents described above as the substituents for the alkyl group.

The alkoxy group shown by $R_{12}$ is preferably an alkoxy group having from 1 to 8 carbon atoms and may be substituted by a halogen atom or an aryl group.

The aryloxy group shown by $R_{12}$ is preferably a monocyclic aryloxy group and may be substituted by a halogen atom, etc.

The amino group shown by $R_{12}$ is preferably an unsubstituted amino group, an alkylamino group having from 1 to 10 carbon atoms, or an arylamino group and the amino group may be substituted by an alkyl group, a halogen atom, a cyano group, a nitro group, a carboxy group, etc.

The carbamoyl group shown by $R_{12}$ is preferably an unsubstituted carbamoyl group, an alkylcarbamoyl group having from 1 to 10 carbon atoms, or an arylcarbamoyl group and may be substituted by an alkyl group, a halogen atom, a cyano group, a carboxy group, etc.

Also, the oxycarbonyl group shown by $R_{12}$ is preferably an alkoxycarbonyl group having from 1 to 10 carbon atoms or an aryloxycarbonyl group and may be substituted by an alkyl group, a halogen atom, a cyano group, a nitro group, etc.

When $G_{11}$ is $$-\overset{\overset{O}{\|}}{C}-,$$

the preferred $R_{12}$ groups are an alkyl group (e.g., methyl, trifluoromethyl, 3-hydroxypropyl, 3-methanesulfonamidopropyl, and phenylsulfonylmethyl), an aralkyl group (e.g., o-hydroxybenzyl), and an aryl group (e.g., phenyl, 3,5-dichlorophenyl, o-methanesulfonamidophenyl, 4-methanesulfonylphenyl, and 2-hydroxymethylphenyl).

When $G_{11}$ is $—SO_2—$, $R_{12}$ is preferably an alkyl group (e.g., methyl), an aralkyl group (e.g., o-hydroxybenzyl), an aryl group (e.g., phenyl), or a substituted amino group (e.g., dimethylamino).

When $G_{11}$ is —SO—, $R_{12}$ is preferably a cyanobenzyl group, a methylthiobenzyl group, etc.

When $G_{11}$ is

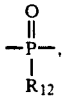

$R_{12}$ is preferably a methoxy group, an ethoxy group, butoxy group, a phenoxy group, or a phenyl group, and is particularly preferably a phenoxy group.

Also, when $G_{11}$ is an N-substituted or unsubstituted iminomethylene group, $R_{12}$ is preferably a methyl group, an ethyl group, or a substituted or unsubstituted phenyl group.

Each of the groups shown by $R_{12}$ may be also substituted by the substituents described above for $R_{11}$.

$G_{11}$ in formula (I) is more preferably

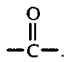

Also, $R_{12}$ may be a group capable of undergoing a cyclic reaction forming a cyclic structure containing the atoms of the moiety of $—G_{11}—R_{12}$ by splitting the moiety of $—G_{11}—R_{12}$ from the remaining molecule and is shown by following formula (a):

$$—R_{13}Z_{11} \qquad (a)$$

wherein $Z_{11}$ represents a group capable of splitting the moiety of $G_{11}—R_{13}—Z_{11}$ from the remaining molecule by attacking nucleophilically $G_{11}$ and $R_{13}$ is a group formed by removing one hydrogen atom from $R_{12}$. By nucleophilically attaching $Z_{11}$ to $G_{11}$, a cyclic structure can be formed by $G_{11}$, $R_{13}$, and $Z_{11}$.

More specifically, $Z_{11}$ is a group capable of readily nucleophilically reacting with $G_{11}$ to split $R_{11}—N=N$ from $G_{11}$ when the hydrazine compound of formula (I*a*) forms the intermediate $R_{11}—N=N—G_{11}—R_{13}—Z_{11}$ by oxidation, etc. $Z_{11}$ may be a functional group which directly reacts with $G_{11}$, such as OH, SH, $NHR_{14}$ (wherein $R_{14}$ represents a hydrogen atom, an alkyl group, an aryl group, $—COR_{15}$ or $—SO_2R_{15}$ (wherein $R_{15}$ represents a hydrogen atom, an alkyl group, an aryl group, a heterocyclic group, etc.)), or COOH or may be a functional group capable of reacting with $G_{11}$ by reacting with a nucleating agent such as a hydroxide ion or a sulfite ion, such as

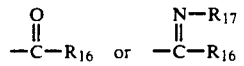

(wherein $R_{16}$ and $R_{17}$ each represents a hydrogen atom, an alkyl group, an alkenyl group, an aryl group, or a heterocyclic group).

The alkyl group shown by $R_{14}$ to $R_{17}$ preferably has 1 to 10 carbon atoms (e.g., methyl, ethyl, and propyl), and the aryl shown by $R_{14}$ to $R_{17}$ preferably has 6 to 10 carbon atoms (e.g., phenyl).

Also, as a ring formed by $G_{11}$, $R_{13}$, and $Z_{11}$, a 5- or 6-membered ring is preferred.

In the groups shown by formula (a) described above, preferred groups are shown by following formulae (b) and (c):

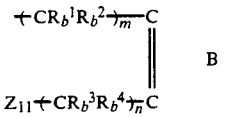

(b)

wherein $R_b^1$, $R_b^2$, $R_b^3$, and $R_b^4$ each represents a hydrogen atom, an alkyl group (preferably having from 1 to 12 carbon atoms), an alkenyl group (preferably having from 2 to 12 carbon atoms), or an aryl group (preferably having from 6 to 12 carbon atoms), and they may be the same or different, B represents an atomic group necessary for forming a 5- or 6-membered ring which may have a substituent, and m and n each represents 0 or 1, n+m being 1 or 2;

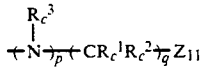

wherein $R_c^1$ and $R_c^2$, which may be the same or different, each represents a hydrogen atom, an alkyl group preferably having 1 to 10 carbon atoms (e.g., methyl, ethyl, and propyl), an alkenyl group, an aryl group preferably having 6 to 10 carbon atoms (e.g., phenyl), or a halogen atom, $R_c^3$ represents a hydrogen atom, an alkyl group, an alkenyl group, or an aryl group, p represents 0, 1 or 2, and q represents an integer from 1 to 4.

Examples of the 5- or 6-membered ring shown by B include a cyclohexene ring, a cyclopentene ring, a benzene ring, a naphthalene ring, a pyridine ring, and a quinoline ring.

$R_c^1$, $R_c^2$ and $R_c^3$ may combine with each other to form a ring if $Z_{11}$ has a structure capable of intramolecularly nucleophilically attacking $G_{11}$.

$R_c^1$ and $R_c^2$ each preferably represents a hydrogen atom, a halogen atom, or an alkyl group, and $R_c^3$ is preferably an alkyl group or an aryl group.

In formula (c), q represents preferably 1, 2 or 3; when q is 1, p preferably represents 1 or 2, when q is 2, p preferably represents 0 or 1, when q is 3, p preferably represents 0 or 1, and when q is 2 or 3, the plural $(CR_c^1R_c^2)$s may be the same or different.

In formulae (b) and (c), $Z_{11}$ has the same meaning as that in formula (a).

In formulae (I*a*), (I*b*) and (I*c*), the sulfonyl group and the acyl group shown by $A_{11}$ and $A_{12}$ are preferably an alkylsulfonyl group having from 1 to 20 carbon atoms or an arylsulfonyl group (more preferably, an unsubstituted phenylsulfonyl group or a phenylsulfonyl group substituted such that the sum of the Hammett's substituent constants becomes −0.5 or more), and an acyl group preferably having not more than 20 carbon atoms (more preferably, an unsubstituted benzoyl group, a benzoyl group substituted such that the sum of the Hammett's substituent constants becomes −0.5 or more, or a straight chain, branched, or cyclic unsubstituted or substituted aliphatic acid group, whose substituent include a halogen atom, an ether group, a sulfonamido group, a carbonamido group, a hydroxy group, a carboxy group, and a sulfonic acid group).

$A_{11}$ and $A_{12}$ are most preferably a hydrogen atom.

In formulae (I*a*) and (I*c*), the divalent organic group shown by $Y_{11}$ represents an aliphatic group, an aromatic group, a heterocyclic group, or a group shown by following formula (d):

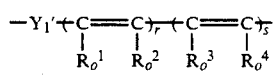

(d)

wherein $Y'_1$ represents an aromatic group or a heterocyclic group, $R_o^1$ to $R_o^4$ each represents a hydrogen atom, a halogen atom, or an alkyl group, and r and s each represents 0 or 1.

The aliphatic group shown by $Y_{11}$ preferably contains 1 to 10 carbon atoms, exemplified with a straight chain, branched, or cyclic alkylene group, an alkenylene group, and an alkynylene group.

The aromatic group shown by formula $Y_{11}$ preferably contains 6 to 10 carbon atoms, exemplified with a monocyclic or bicyclic arylene group such as a phenylene group and a naphthylene group, and a phenylene group is particularly preferred.

$Y_{11}$ is more preferably an arylene group, and particularly preferably a phenylene group.

The divalent heterocyclic group shown by $Y_{21}$ in formula (I*b*) is preferably a 5- or 6-membered heterocyclic ring which may be a monocyclic ring or may form a condensed ring with an aromatic ring or an other heterocyclic ring. Practical examples of the heterocyclic ring include; a pyridine ring, an imidazole ring, a benzimidazole ring, a pyrazole ring, a pyrimidine ring, a triazine ring, a quinoline ring, an isoquinoline ring, a furan ring, a thiophene ring, a benzofuran ring, etc.

Each group shown by $Y_{11}$ and $Y_{21}$ may have a substituent and examples of the substituent are a nitro group and those illustrated above as the substituents of $R_{11}$, $R_{21}$ and $R_{31}$.

$R_{11}$, $R_{12}$, $R_{21}$, $R_{31}$, $Y_{11}$ or $Y_{21}$ in formulae (I*a*), (I*b*) and (I*c*) may contain therein a ballast group or a polymer ordinary used in immobile photographic additives such as couplers.

A ballast group is a group having 8 or more carbon atoms, which is relatively inactive to photographic properties, and is composed of one of an alkyl group, an alkoxy group, a phenyl group, an alkylphenyl group, a phenoxy group, an alkylphonoxy group, an ether group, an amido group, a ureido group, a urethane group, a sulfonamido group, a thioether group, etc. or a combination of two or more.

Also, examples of the aforesaid polymer are those described in JP-A-1-100530.

$R_{11}$, $R_{12}$, $R_{21}$, $R_{31}$, $Y_{11}$ or $Y_{21}$ may contain therein a group promoting its adsorption to the surface of silver halide grains.

Such adsorption promoting groups include a thiourea group, a heterocyclic thioamido group, a mercaptoheterocyclic group, a triazole group, etc., described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-.1-627044, JP-A-62-948, JP-A-63-234244, and JP-A-63-234246.

In particular, in the compound shown by formulae (I*a*), (I*b*) and (I*c*) it is preferred that $R_{11}$, $R_{12}$, $R_{31}$, $Y_{11}$ or $Y_{21}$ has a group promoting adsorption $X_1(Y'_2)_l$ to the surface of silver halide grains. In the formula, $X_1$ represents an adsorption accelerating group to the surface of silver halide grains, $Y'_2$ represents a divalent linkage group, and l represents 0 or 1.

Preferred examples of the adsorption accelerating group shown by $X_1$ are a thioamido group, a mercapto group, a group having a disulfide bond, and a 5- or 6-membered nitrogen-containing heterocyclic group.

The thioamido adsorption accelerating group shown by $X_1$ is a divalent group shown by

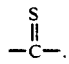

which may be a part of a ring structure or a noncyclic thioamido group.

Useful thioamido adsorption accelerating groups can be selected from these disclosed in U.S. Pat. Nos. 4,0303,925, 4,031,127, 4,080,207, 4,245,037, 4,255,511, 4,266,013, and 4,276,364, *Research Disclosure*, Vol. 151, No. 15162 (Nov., 1976), and ibid., Vol. 176, No. 17626 (Dec., 1978).

Specific examples of the noncyclic thioamido group are thioureido, thiourethane, and dithiocarbamic acid ester. Also, specific examples of the cyclic thiamido group include 4-thiazoline-2-thione, 4-imidazoline-2-thione, 2-thiohydratoin, rhodanine, thiobarbituric acid, tetrazoline-5-thione, 1,2,4-triazoline-3-thione, 1,3,4-thiadiazoline-2-thione, 1,3,4-oxadiazoline-2-thione, benzimidazoline-2-thione, benzoxazoline-2-thione, and benzothiazoline-2-thione. These groups may further be substituted.

The mercapto groups shown by $X_1$ include analiphatic mercapto group, an aromatic mercapto group, and a heterocyclic mercapto group (when the atom adjacent to the carbon atom bonded to -SH is a nitrogen atom, the heterocyclic mercapto group has the same meaning as a cyclic thioamido group which is in the relation of a tautomer to it, and the specific examples of the group are same as those illustrated above).

As the 5- or 6-membered nitrogen-containing heterocyclic group shown by Xl, there are 5- or 6-membered nitrogen-containing heterocyclic ring composed of a combination of nitrogen, oxygen, sulfur, and carbon. Preferred examples thereof are benzotriazole, triazole, tetrazole, indazole, benzimidazole, imidazole, benzothiazole, thiazole, benzoxazole, oxazole, thiadiazole, oxadiazole, and triazine. These groups may be further substituted with a proper substituent. Examples of the substituents are those described above as the substituents of $R_{11}$, $R_{21}$ and $R_{31}$.

Preferred groups shown by $X_1$ are a cyclic thioamido group (that is, a mercapto-substituted nitrogen-containing heterocyclic ring, such as, 2-mercaptothiadiazole, 3-mercapto-1,2,4-triazole, 5-mercaptotetrazole, 2-mercapto-1,3,4-oxadiazole, and 2-mercaptobenzoxazole) and a nitrogen-containing heterocyclic group (e.g., benzotriazole, benzimidazole, and indazole).

Two or more $X_1$-$Y'_{2-l}$ may be substituted and in this case, they may be the same or different.

The divalent linkage group shown by $Y'_2$ is an atom selected from C, N, S, and O or an atomic group containing at least one cf C, N, S, and O. Practically, the divalent linkage group is composed of an alkylene group, an alkenylene group, an alkynylene group, an arylene group, —O—, —S—, —NH—, —N=, —CO—, or —$SO_2$— (these groups may have a substituent), either singly or a combination of the aforesaid groups.

Specific examples of the divalent group shown by $Y'_2$ include —CONH—, —NHCONH—, —$SO_2$NH—, —COO—, —NHCOO,

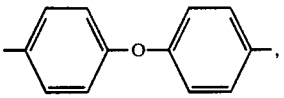

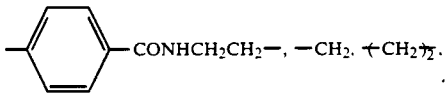

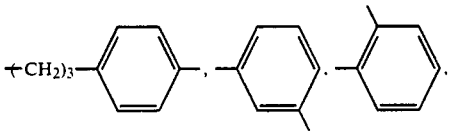

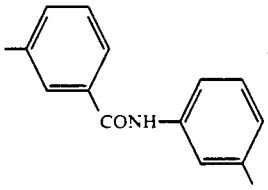

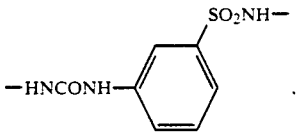

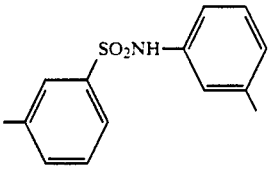

-continued

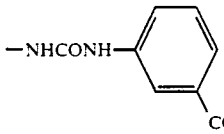

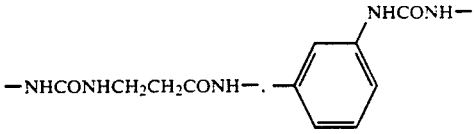

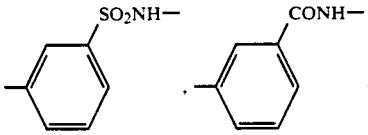

—$CH_2CH_2SO_2NH$—, and —$CH_2CH_2CONH$—.

The aforesaid groups may be substituted by a proper substituent. Examples of the substituents include those described above as the substituents of $R_{11}$, $R_{21}$ and $R_{31}$.

Of the compounds shown by aforesaid formula (I*c*), those represented by formula (I*c*') are preferred

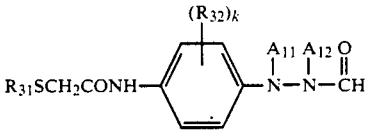

(Ic')

wherein $R_{32}$ has the same meaning as the substituent of $R_{31}$ in formula (I*c*), $R_{31}$, $A_{11}$, and $A_{12}$ have the same meanings as those described in formula (I*c*), and k represents 0, 1, or 2.

Specific examples of the compound shown by formula (Ia) are illustrated below, but the invention is not limited to these compounds Ia-1

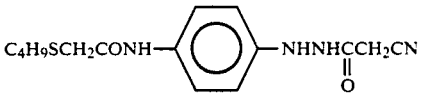

Ia-2

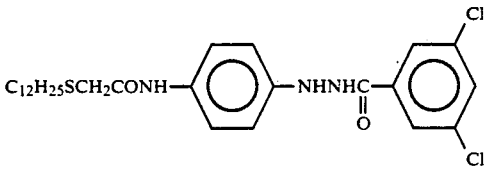

Ia-3

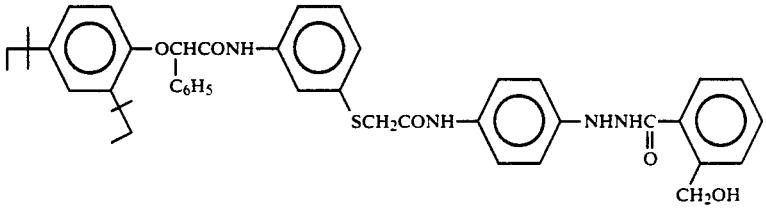

-continued
Ia-4
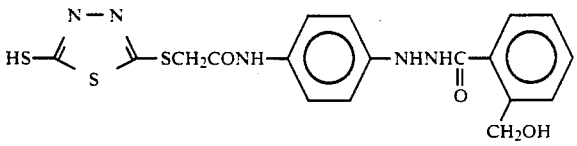
Ia-5
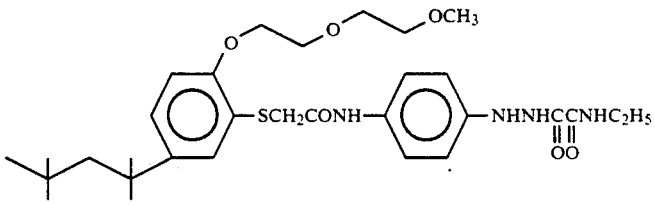
Ia-6
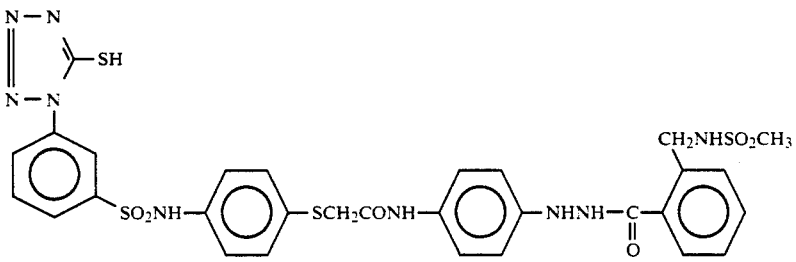
Ia-7
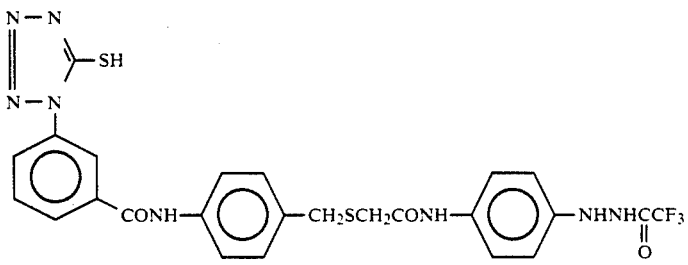
Ia-8
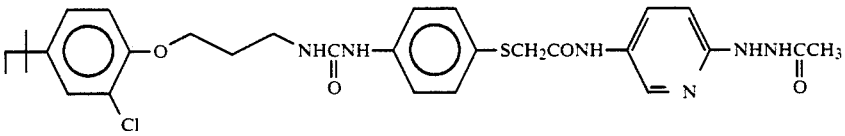
Ia-9
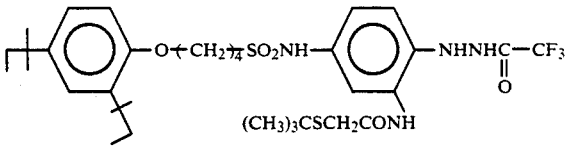
IA-10
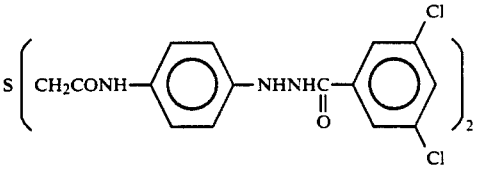
Ia-11
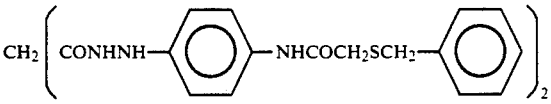

-continued
Ia-12
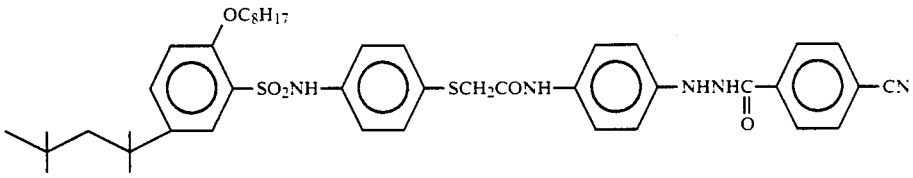
Ia-13
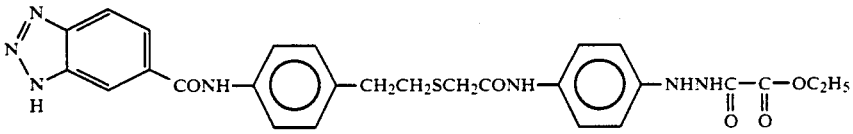
Ia-14
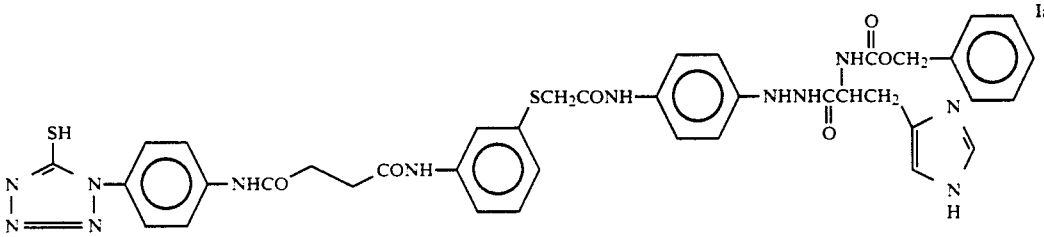
Ia-15
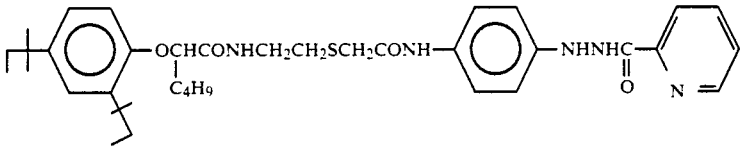
Ia-16
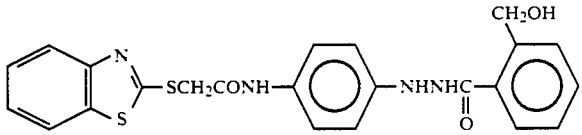
Ia-17
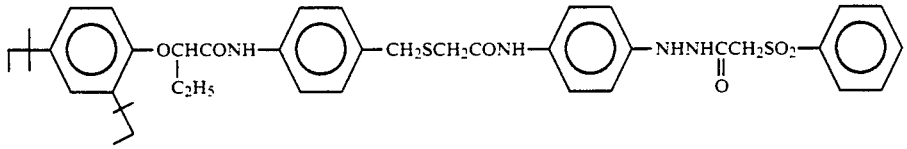
Ia-18
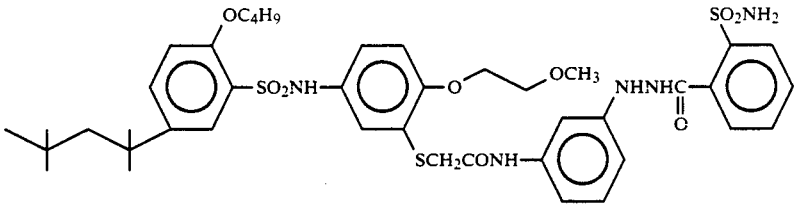
Ia-19
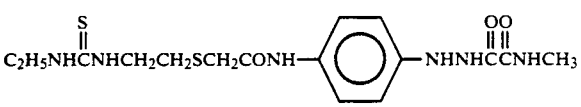
Ia-20
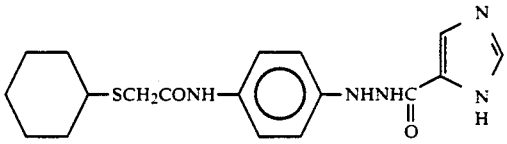

-continued
Ia-21
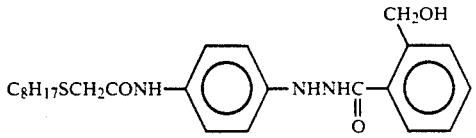
Specific examples of the compound shown by formula (I*b*) are illustrated below, but the invention is not limited to these compounds.
Ib-1
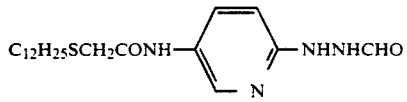
Ib-2
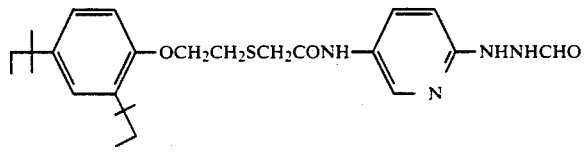
Ib-3
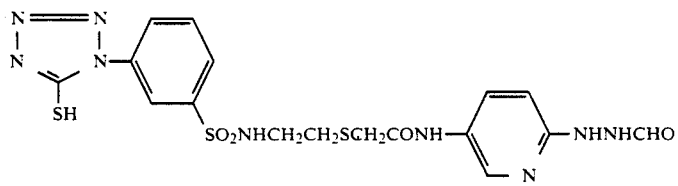
Ib-4
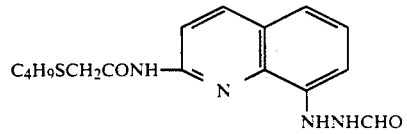
Ib-5
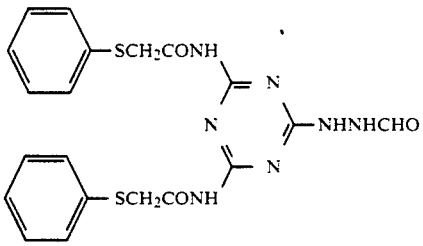
Ib-6
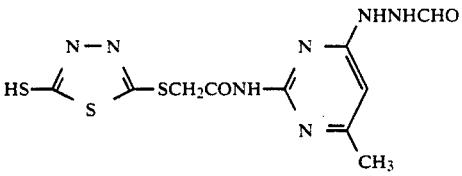
Ib-7
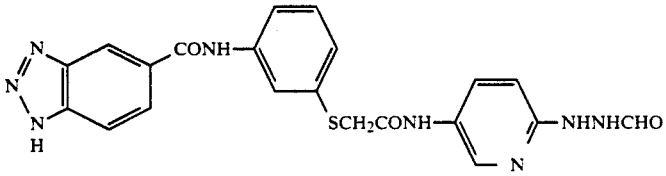

-continued
Ib-8
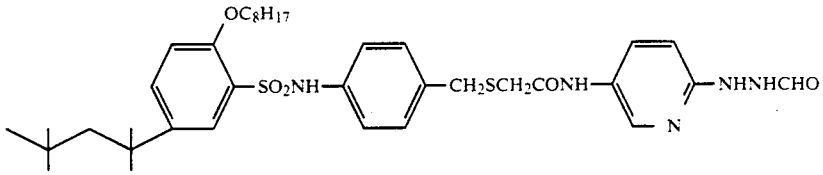
Ib-9
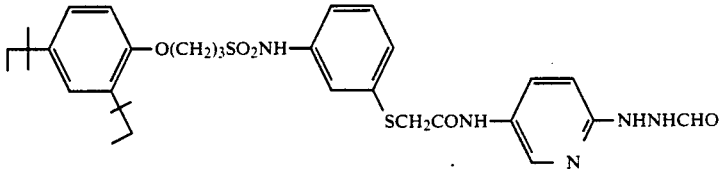
Ib-10
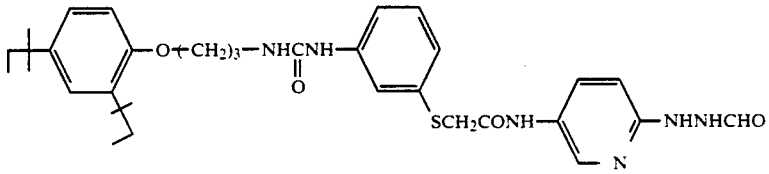
Ib-11
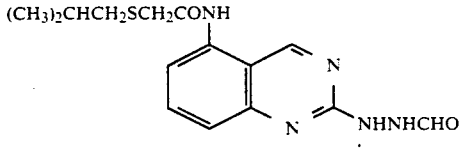
Ib-12
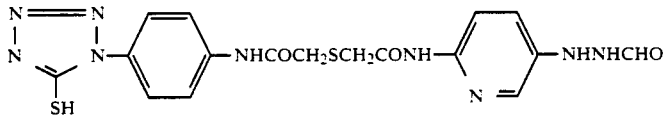
Specific examples of the compound shown by formula (Ic) are illustrated below, but the invention is not limited to these compounds.
Ic-1
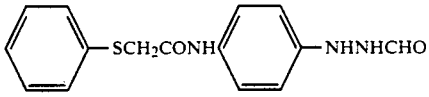
Ic-2
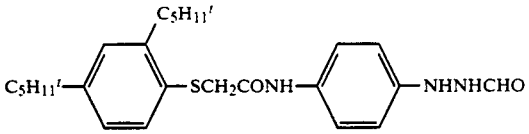
Ic-3
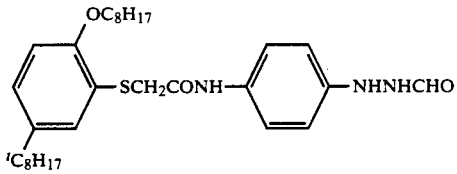
Ic-4
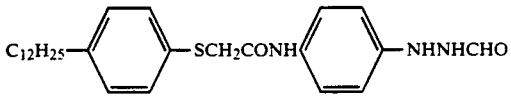
Ic-5
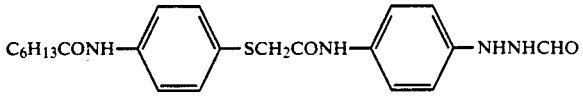

-continued
Ic-6
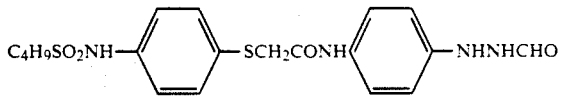
Ic-7
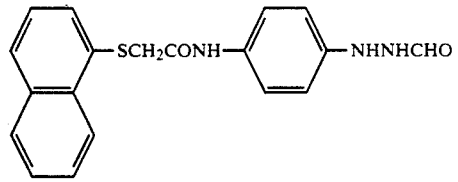
Ic-8
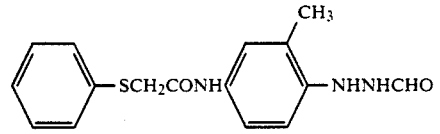
Ic-9
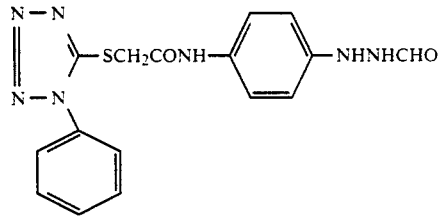
Ic-10
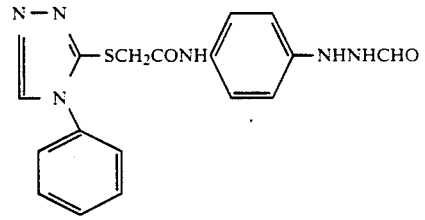
Ic-11
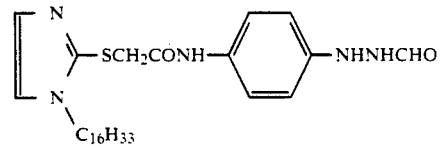
Ic-12
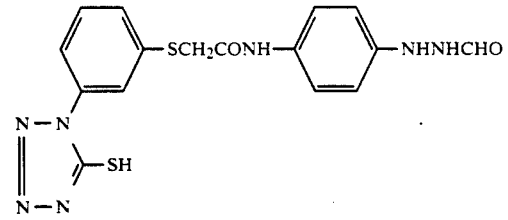
Ic-13
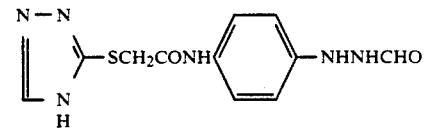
Ic-14
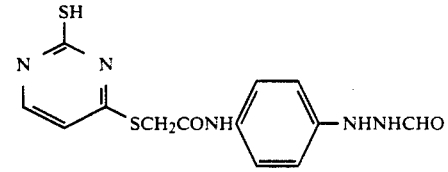

-continued

Ic-15

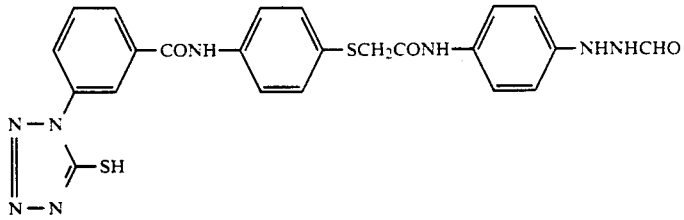

Ic-16

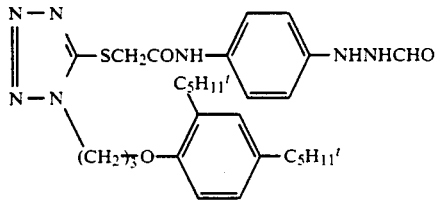

Ic-17

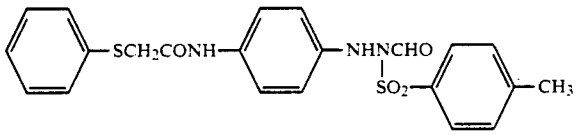

The hydrazine derivative of formulae (I*a*), (I*b*) and (I*c*) for use in this invention can be ordinarily synthesized by reacting a corresponding chloroacetamide-substituted hydrazine compound and a corresponding thiol in the presence of a base. For example, the compound of formula (I*a*) can be synthesized by the following reaction equation:

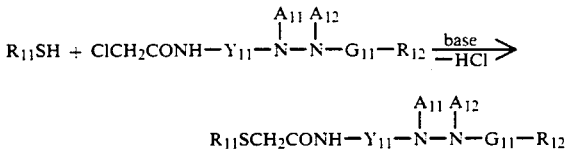

The compounds of formulae (I*b*) and (I*c*) can be synthesized in the same manner.

In the aforesaid reaction, a solvent such as acetonitrile, dimethylformamide, dioxane, tetrahydrofuran, dimethylacetamide, etc., can be used and as the base, triethylamine, N-ethylpiperidine, N-methylmorpholine, pyridine, imidazole, sodium methoxide, sodium hydroxide, etc., can be used.

Typical synthesis examples of the compounds shown by formulae (Ia), (Ib) and (Ic) are explained below.

SYNTHESIS EXAMPLE 1

(Synthesis of Compound I*a*-2)

To a mixture of 4.2 g of dodecanethiol, 100 ml of methanol, and 5.1 g of sodium ethylate (28 wt % ethanol solution) was added gradually 7.0 g of a solid compound shown by the following formula under ice-cooling:

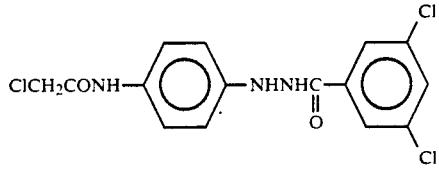

under a nitrogn gas atmosphere. Thereafter, the mixture was stirred overnight while allowing the temperature to gradually rise to room temperature, and then, volatile matters were distilled off under reduced pressure. The reaction product was purified by silica chromatography to provide Compound I*a*-2, in an amount of 5.2 g.

The chemical structure was confirmed by nuclear magnetic resonance (NMR) spectra, infrared (IR) spectra and elemental analysis.

SYNTHESIS EXAMPLE 2

(Synthesis of Compound I*b*-1)

To a mixture of 4.2 g of dodecanethiol, 100 ml of methanol, and 5.1 g of sodium ethylate (28 wt % ethanol solution) was gradually added 4.3 g of a solid compound of the following formula under ice-cooling:

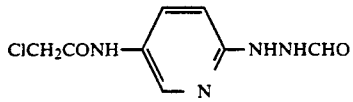

under a nitrogen gas atmosphere. Thereafter, the mixture was stirred overnight while allowing the temperature to gradually rise to room temperature, and then, volatile matters were distilled off under reduced pressure. The reaction product was purified by silica chromatography to provide 3.6 g of Compound Ib-1.

The chemical structure was confirmed by NMR spectra, IR spectra and the elemental analysis.

SYNTHESIS EXAMPLE 3

(Synthesis of Compound Ic-3)

In 25 ml of dimethylformamide was dissolved 17.5 g (0.05 mol) of 2-octyloxy-5-tert-octylthiophenol and after cooling the reaction temperature to 0° C. as the solution was well stirred in a nitrogen gas atmosphere, 9.6 g of a 28 wt % methanol solution of sodium methoxide was added to the solution and then 11.4 g (0.05 mol) of the powder of 2-(4-chloroacetamidophenyl)-1-formylhydrazine was added thereto.

After reacting for about 2 hours, the reaction mixture was poured into 400 ml of water. The reaction product was extracted with ethyl acetate, dried with anhydrous sodium sulfate, and then ethyl acetate was distilled off. The oily residue was isolated and purified by silica gel column chromatography (separated by a mixture of dichloromethane and methanol of 10/1) to provide 23 g (85%) of Compound Ic-3.

For incorporating the hydrorazine derivative of this invention into an emulsion for use in this invention, the compound is dissolved in water or a water-miscible organic solvent (if necessary, the compound may be dissolved as a salt thereof by adding thereto an alkali hydroxide or a tertiary amine) and then the solution is added to an aqueous hydrophilic colloid solution (e.g., a silver halide emulsion, an aqueous gelatin solution, etc.) (in this case, if necessary, the pH may be adjusted by the addition of an alkali or an acid).

The compounds of formulae (I*a*), (I*b*) and (I*c*) for use in this invention can be used singly or as a mixture thereof. The addition amount of the compound in this invention is preferably from $1\times10^{-6}$ to $5\times10^{-2}$ mol, more preferably from $1\times10^{-5}$ to $1\times10^{-2}$ mol per mol of silver halide, and can be suitably selected according to the properties of the silver halide emulsion being combined therewith.

When the compound of this invention is used with a negative working silver halide emulsion, negative images having a higher contrast can be formed. The compound can also be used with an internal latent image type silver halide emulsion.

In the case of utilizing the compound for the formation of negative images having a high contrast, it is preferred that the mean grain size of silver halide grains used is fine (i.e., not larger than 0.7 μm), and the fine grains of not more than 0.5 μm are more preferred.

There is no particular restriction on the grain size distribution, but a monodisperse silver halide emulsion is preferred. The term "monodisperse" means that at least 95% by weight or grain number of silver halide grains have grain sizes within ±40% of the mean grain size.

The silver halide grains in the photographic emulsion for use in this invention may be a regular crystal form such as a cubic form, an octahedral form, a rhombic dodecahedral form, and a tetradecahedral form, an irregular crystal form such as a sphere, a tabular form, etc., or a composite form of these crystal forms.

The silver halide composition of the silver halide emulsion for use in this invention may be silver chloride, silver chlorobromide, silver iodobromide, silver iodochlorobromide, etc.

The silver halide grains may be composed of a homogeneous phase on the inside and the surface layer thereof or may be composed of a different phase between the inside and the surface layers thereof.

In the silver halide emulsion for use in this invention, a cadmium salt, a sulfite, a lead salt, a thallium salt, a rhodium salt or a complex salt thereof, an iridium salt or a complex salt thereof, etc., may be present in the step of forming the silver halide grains or the physical ripening of the emulsion.

The silver halide for use in this invention is generally prepared in the presence of an iridium salt or a complex salt thereof in an amount of from $1\times10^{-8}$ to $1\times10^{-5}$ per mol of silver. It is preferred that the silver iodide is contained in the silver halide grains and its content on the surface of the grains is larger than the mean silver iodide content in the whole grain. When a silver halide emulsion containing such a silver haloiodide is used, photographic characteristics having a higher sensitivity and a higher gamma are obtained.

The silver halide emulsion for use in this invention ma be or may not be chemically sensitized.

As a chemical sensitization method for a silver halide emulsion, sulfur sensitization, reduction sensitization, and noble metal sensitization are known. These sensitization methods may be used singly or as a combination thereof.

In a noble metal sensitization method, a gold sensitization method is typical and as a gold compound, a gold complex salt is mainly used. However, other noble metal complex salts such as a complex salt of platinum, palladium, rhodium, etc., may be used. Practical examples thereof are described in U.S. Pat. No. 2,448,060 and British Patent 618,016.

As a sulfur sensitizer, there are a sulfur compound contained in gelatin and other various sulfur compounds such as thiosulfates, thioureas, thiazoles, rhodanines, etc.

In the aforesaid case, it is preferred to use an iridium salt or a rhodium salt before finishing physical ripening in the production step of the silver halide emulsion, in particular, at the formation of silver halide grains.

In view of increase in the maximum density (Dmax), it is preferred that the silver emulsion layer contain two kinds of monodisperse silver halide emulsions each having a different mean grain size as disclosed in JP-A-61-223734 and JP-A-62-90646 and in this case, it is preferred that the monodisperse silver halide emulsion having a small mean grain size be chemically sensitized. As the chemical sensitizing method, a sulfur sensitization is most preferred. The monodisperse silver halide emulsion having a large mean grain size may be or may not be chemically sensitized. Since the monodisperse silver halide emulsion having a large mean grain size is generally likely to cause black pepper, the silver halide emulsion is not usually subjected to a chemical sensitization. But if the large grain size monodisperse silver halide emulsion is, as the case may be, chemically sensitized, it is preferred to lightly apply the chemical sensitization to the extent of not causing black peppers. The term "lightly apply" means that the time of applying the chemical sensitization is shortened, the temperature of the chemical sensitization is lowered, or the addition amount of the chemical sensitizer is reduced as compared to the case of chemically sensitizing the small mean grain size monodisperse emulsion.

There is no particular restriction on the sensitivity difference between the large mean grain size monodisperse emulsion and the small mean grain size monodisperse emulsion but ΔlogE is from 0.1 to 1.0, and preferably from 0.2 to 0.7, and it is preferred that the sensitivity of the large mean grain size monodisperse emulsion is higher. In this case, the above-described sensitivity of each silver halide emulsion is the value measured by coating the silver halide emulsion containing the hydrazine derivative on a support and processing the emulsion layer using a developer containing at least 0.15 mol/liter of a sulfite ion and having pH of from 10.5 to 12.3.

The mean grain size of the small grain size monodisperse silver halide grains is less than about 90%, and preferably less than about 80% of the mean grain size of the large grain size monodisperse silver halide grains. The mean grain size of silver halide grains of the silver halide emulsion for use in this invention is in the range of from 0.02 μm to 1.0 μm, and more preferably from 0.1 μm to 0.5 μm. It is preferred that the mean grain size of the large grain size monodisperse silver halide grains and the mean grain size of the small grain size monodisperse silver halide grains are fallen within the range.

When two or more kinds of silver halide emulsions each having a different mean grain size are used in this invention, the coating silver halide of the small grain size monodisperse emulsion is preferably from 40 to 90% by weight, and more preferably from 50 to 80% by weight of the total coating silver amount.

As a method of introducing monodisperse silver halide emulsions each having a different mean grain size in this invention, the emulsions may be introduced into the same emulsion layer or may be introduced into different emulsion layers. In the case of introducing the monodisperse silver halide emulsions into different emulsion layers, it is preferred that a large grain size monodisperse silver halide emulsion is used as an upper layer and a small grain size monodisperse silver halide emulsion is used as a lower layer.

In addition, the total coating silver amount is preferably from 1 to 8 g/m$^2$.

The photographic light-sensitive material for use in this invention can contain a sensitizing dye (e.g., a cyanine dye and a merocyanine dye) described in JP-A-55-52050, pages 45 to 53 for the purpose of increasing the sensitivity. The sensitizing dyes may be used singly or in a combination thereof. A combination of sensitizing dyes is frequently used for the purpose of super color sensitization.

The photographic light-sensitive material may further contain a dye which has no spectral sensitizing action by itself or does not substantially absorb visible light but which shows a super color sensitization together with the sensitizing dye(s).

Useful sensitizing dyes, combinations of dyes showing a super color sensitization, and materials showing super color sensitization are described in *Research Disclosure*, Vol. 176, No. 17643, pages 23, IV-J (Dec., 1978).

The photographic light-sensitive materials of this invention can contain various compounds for preventing the formation of fog during the production, storage, and photographic processing of the light-sensitive materials and for stabilizing the photographic performance thereof.

That is, there are various compounds known as antifoggants or stabilizers, such as azoles (e.g., benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, and nitrobenzotriazoles); mercaptopyrimidines; mercaptotriazines; thioketo compounds (e.g., oxazolinethione); azaindenes (e.g., triazaindenes, tetraazaindenes (in particular, 4-hydroxy-substituted (1,3,3a,7)tetraazaindenes), and pentaazaindenes); benzenethiosulfonic acid; benzenesulfinic acid; benzenesulfonic acid amide, etc.

Among these materials, benzotriazoles (e.g., 5-methylbenzotriazole) and nitroindazoles (e.g., 5-nitroimidazole) are preferred. These materials may be added to a processing solution.

As development accelerators or accelerators for nucleating infectious development suitably used in this invention, the compounds disclosed in JP-A-53-77616, JP-A-54-37732, JP-A-53-137133, JP-A-60-140340, and JP-A-60-14959 and also various compounds containing N or S are effective.

The optimum addition amount of such an accelerator depends upon the kind of the compound, but it is ordinarily desirable that the compound be used in the range of form $1.0\times10^{-3}$ to 0.5 g/m$^2$, and preferably from $5.0\times10^{-3}$ to 0.1 g/m$^2$.

The photographic light-sensitive material of this invention may further contain a desensitizer in the photographic emulsion layer or other hydrophilic colloid layer.

The organic desensitizer which is used in this invention has a positive polarographic half wave potential, that is, the sum of a polarographic anodic potential and a polarographic cathodic potential regulated by the oxidation reduction potential determined by polarography becomes positive.

The measurement method of the oxidation reduction potential of polarography is described in U.S. Pat. No. 3,501,307. The organic desensitizer has preferably at least one water-soluble group such as, practially, a sulfonic acid group, a carboxylic acid group, a phosphonic acid group. These groups may form salts with an organic base (e.g., ammonia, pyridine, triethylamine, piperidine, and morpholine) or an alkali metal (e.g., sodium and potassium).

As the organic desensitizer for use in this invention, the compounds shown by formulae (III) to (V) described in Japanese Patent Application No. Sho-61-280998 (corresponding to JP-A-63-133145), pages 55 to 72 are preferred.

It is preferred in this invention that the organic desensitizer exists in the silver halide emulsion layer in an amount of from $1.0\times10^{-8}$ to $1.0\times10^{-4}$ mol/m$^2$, and particularly from $1.0\times10^{-7}$ to $1.0\times10^{-5}$ mol/m$^2$.

The silver halide emulsion layer or other hydrophilic colloid layer in this invention may further contain a water-soluble dye as a filter dye or for other various purposes such as irradiation prevention.

As the filter dye, a dye for further lowering the photographic sensitivity, preferably an ultraviolet absorbent having a spectral absorption maximum in the intrinsic sensitivity region of silver halide, or a dye having a a substantial light absorption in the region of mainly from 380 nm to 600 nm for improving the safety to a safe light during handling of the photographic light-sensitive material in bright room is used.

It is preferred that the aforesaid dye is incorporated in the silver halide emulsion layer or an insensitive hydrophilic colloid layer disposed over the silver halide emulsion layer by fixing them together with a mordant.

The addition amount of the ultraviolet absorbent depends upon the mol extinction coefficient of the ultraviolet absorbent, but is usually used in the range of from $10^{-2}$ g/m$^2$ to 1 g/m$^2$, and preferably from 50 mg/m$^2$, to 500 mg/m$^2$.

The aforesaid ultraviolet absorbent can be added to a coating composition as a solution thereof in a proper solvent (e.g., water, alcohols (e.g., methanol, ethanol, and propanol), acetone, methylcellosolve, and a mixture thereof).

Examples of the ultraviolet absorbent are aryl-substituted benzotriazole compounds, 4-thiazolidone compound, benzophenone compounds, cinnamic acid ester compounds, butadiene compounds, benzoxazole compounds, and ultraviolet absorptive polymers.

Practical examples of the ultraviolet absorbent are described in U.S. Pat. Nos. 3,533,794, 3,314,794, 3,352,681, 3,705,805, 3,707,375, 4,045,229, 3,700,455, and 3,499,762, JP-A-46-2784, and West German Patent Publication 1,547,863.

As the filter dye, there are oxonol dyes, hemioxonol dyes, styryl dyes, merocyanine dyes, cyanine dyes, and azo dyes. In these dyes, water-soluble dyes or dyes decoloring with an alkali or a sulfite ion are preferred from the point of view of reducing residual color after processing.

Specific examples of the filter dyes are pyrazoloneoxonol dyes described in U.S. Pat. No. 2,274,782, diarylazo dyes described in U.S. Pat. No. 2,956,879, styryl dyes and butadienyl dyes described in U.S. Pat. Nos. 3,423,207 and 3,384,487, merocyanine dyes described in U.S. Pat. No. 2,527,583, merocyanine dyes and oxonol dyes described in U.S. Pat. Nos. 3,486,897, 3,652,284, and 3,718,472, enaminohemioxonol dyes described in U.S. Pat. No. 3,976,661, and the dyes described in British Patent 584,609 and 1,177,429, JP-A-48-85130, JP-A-49-99620, and JP-A-49-114420, U.S. Pat. Nos. 2,533,472, 3,148,187, 3,177,078, 3,247,127, 3,540,887, 3,575,704, and.3,653,905.

The aforesaid dye is added to the coating composition for the insensitive hydrophilic colloid layer in this invention as a solution thereof in a proper solvent (e.g., water, alcohols (e.g., methanol, ethanol, and propanol), acetone, methylcellosolve, and a mixture of them).

The amount of the filter dye is generally in the range of from $1\times10^{-3}$ g/m$^2$ to 1 g/m$^2$, and preferably rom $1\times10^{-3}$ g/m$^2$ to 0.5 g/m$^2$.

The photographic light-sensitive material may contain an inorganic or organic hardening agent in the photographic silver halide emulsion layer(s) and other hydrophilic colloid layer(s). Examples of such hardening agents are chromium salts, aldehydes (e.g., formaldehyde and glutar aldehyde), N-methylol compounds (e.g., dimethylolurea), active vinyl compounds (e.g., 1,3,5-triacryloyl-hexahydro-s-triazine and 1,3-vinylsulfonyl-2-propanol), active halogen compounds (e.g., 2,4-dichloro-6-hydroxy-s-triazine), and mucohalogenic acids. They can be used singly or in a combination thereof.

The photographic silver halide emulsion layer(s) and other hydrophilic colloid layer(s) of the photographic light-sensitive material of this invention may contain various kinds of surface active agents for various purposes such as a coating aid, as well as for static prevention, improvement of slidability, improvement of emulsification-dispersion, sticking prevention, and improvement of photographic characteristics (e.g., development acceleration, contrast increasing, and sensitization).

Surface active agents which are particularly preferably used in this invention are polyalkylene oxides having a molecular weight of at least 600 described in JP-B-58-9412 (the term "JP-B" as used herein means an "examined published Japanese patent application"). Also, when the surface active agent is used as an antistatic agent, fluorine-containing surface active agents as described in U.S. Pat. No. 4,201.586, JP-A-60-80849 and JP-A-59-74554 are particularly preferred.

The photographic light-sensitive material of this invention can further contain a matting agent such as silica, magnesium oxide, polymethyl methacrylate, etc., in the photographic silver halide emulsion layer(s) and other hydrophilic colloid layer(s) for the purpose of sticking prevention.

Also, the photographic silver halide emulsion layer(s) in this invention can contain a dispersion of a water-insoluble or water sparingly soluble synthetic polymer for the purpose of improving the dimensional stability. For example, polymers of an alkyl acrylate or methyacrylate (collectively referred to as "(meth)acrylate"), an alkoxyalkyl (meth)acrylate, glycidyl (meth)acrylate, etc., solely or as a mixture thereof, or a mixture of the aforesaid monomer and another monomer such as acrylic acid, methacrylic acid, etc., can be used.

It is preferred that the silver halide emulsion layer(s) and other hydrophilic colloid layer(s) of the photographic light-sensitive material of this invention contain a compound having an acid group. As the compound having an acid group, there are an organic acid such as salicylic acid, acetic acid, ascorbic acid, etc., and a polymer or a copolymer having an acid monomer such as acrylic acid, maleic acid, phthalic acid, etc., as a recurring unit. These compounds are described in JP-A-61-223834, JP-A-61-228437, JP-A-62-25745, and JP-A-62-55642. In these compounds, ascorbic acid is particularly preferred as a low molecular compound. As a high molecular compound, a water dispersible latex of a copolymer composed of an acid monomer such as acrylic acid and a crosslinking monomer having two or more unsaturated groups, such as divinylbenzene.

For obtaining the photographic characteristics having a super high contrast and a high sensitivity using the silver halide photographic material of this invention, a stable developer can be used without the need of using a conventional infectious developer or a high alkaline developer having a pH near 13 as described in U.S. Pat. No. 2,419,975.

That is, by developing the silver halide photographic material of this invention with a developer containing at least 0.15 mol/liter of a sulfite ion as a preservative and having a pH of from 10.5 to 12.3, and particularly from 11.0 to 12.0, sufficiently super high contrast negative images can be obtained.

There is no particular restriction on the developing agent which is used for the developer for developing the light-sensitive material of this invention, but it is preferred to use a dihydroxybenzene from the view of easily obtaining a good dot image quality. A combination of a dihydroxybenzene and a 1-phenyl-3-pyrazolidone or a combination of a dihydroxybezene and a p-aminophenol can be used. The amount of the developing agent is preferably from 0.05 mol/liter to 0.8 mol/liter. Also, when a combination of a dihydroxybenzene and a 1-phenyl-3-pyrazolidone or a p-aminophenol, it is preferred that the former component is used in an amount of from 0.05 mol/liter to 0.5 mol/liter and the latter is in an amount of less than about 0.06 mol/liter.

As a sulfite which is used as a preservative in this invention, there are sodium sulfite, potassium sulfite, lithium sulfite, ammonium sulfite, sodium hydrogensulfite, potassium metahydrogensulfite, sodium formaldehydehydrogensulfite, etc. The amount of the sulfite is preferably at least 0.4 mol/liter, and particularly preferably at least 0.5 mol/liter.

For the developer for developing the light-sensitive material of this invention, the compounds described in JP-A-56-24347 can be used as a silver stain inhibitor.

The developer for use in this invention can contain the compound described in JP-A-61-267759 as a dissolution aid. Furthermore, the developer can contain the compound described in JP-A-60-93433 or the compound described in JP-A-62-186259 as a pH buffer.

The compound shown by formulae (I*a*), (I*b*) and (I*c*) for use in this invention can be used for a high contrast photographic light-sensitive material by combining it with a negative working silver halide emulsion.

It can also be combined with an internal latent image type silver halide emulsion. In this case, it is preferred that the compound shown by formulae (Ia), (Ib) and (I*c*) be incorporated in the internal latent image type silver halide emulsion layer, but it may be also incorporated in a hydrophilic colloid layer adjacent to the internal latent image type silver halide emulsion layer. Such a layer may be a layer such as a coloring material layer, an interlayer, a filter layer, a protective layer, an antihalation layer, etc., if such a layer does not obstruct the nucleating agent from diffusing into the silver halide emulsion layer.

It is desirbale that the content of the compound of formula (I*a*), (I*b*) or (I*c*) in the layer is an amount giving sufficient maximum density (e.g., at least 1.0 in silver density) when the internal latent image type emulsion layer is developed by a surface developer. Practically, the content depends upon the character of the silver halide emulsion being used, the chemical structure of the nucleating agent, and the developing condition. Hence the proper content thereof can be changed in a wide range but is practically in the range of from about 0.005 mg to 500 mg, and preferably from about 0.01 mg to about 100 mg, per mol of silver in the internal latent image type silver halide emulsion.

When the compound of this invention is incorporated in a hydrophilic colloid layer adjacent to the emulsion layer, the content thereof may be the aforesaid amount relative to silver contained in the internal latent image type silver halide emulsion layer of the same area.

The definition of the internal latent image type silver halide emulsion is described in JP-A-61-170733, page 10 and British Patent 2,089,057, pages 18–20.

The preferred internal latent image type silver halide emulsion is described in Japanese Patent Application No. Sho-61-253716 (corresponding to JP-A-63-108336), page 28 line 14 to page 31 line 2, and also preferred silver halide grains are described in the same Japanese patent specification, page 31 line 3 to page 32 line 11.

The internal latent image type silver halide emulsion of the photographic light-sensitive material of this invention may be spectrally sensitized to blue light having a relatively long wave length, green light, red light, or infrared light, using a sensitizing dye. As the sensitizing dye, there are cyanine dyes, merocyanine dyes, complex cyanine dyes, complex merocyanine dyes, holopolar cyanine dyes, styryl dyes, hemicyanine dyes, oxonol dyes, hemioxonol dyes, etc. These sensitizing dyes include cyanine dyes and merocyanine dyes described in JP-A-59-40638, JP-A-59-40636, and JP-A-59-8739.

The photographic light-sensitive material of this invention can contain color image-forming couplers as coloring materials or can be developed by developers containing dye image-forming couplers.

Practical examples of the cyan. magenta. and yellow forming couplers which can be used in this invention are described in the patents cited in *Research Disclosure*, No. 17643, VII-D (Dec., 1978) and *ibid.*, No. 18717 (Nov., 1979)

A coupler giving a colored dye having a proper diffusibility, a non-coloring coupler, a DIR coupler releasing a development inhibitor with a coupling reaction, or a coupler releasing a development accelerator with a coupling reaction can be also used in this invention.

Typical yellow couplers which can be used in this invention include oil protect type acylacetamide type couplers.

In this invention, two-equivalent yellow couplers are preferably used and typical examples are oxygen atom-releasing type yellow couplers and nitrogen C atom-releasing type yellow couplers. Also, α-pivaloylacenilide type couplers are excellent in the fastness, in particular light fastness, of the colored dye formed. On the other hand, α-benzoylacetanilide series couplers give a high coloring density.

As the magenta coupler which can be used in this invention, there are oil protect type indazolone series or cyanoacetyl series couplers, preferably pyrazoloazole series couplers such as 5-pyrazolone series and pyrazolotriazole series couplers. A 5-pyrazolone series coupler having an arylamino group or an acylamino group at the 3-position is preferred from the view point of the hue and coloring density of the colored dye formed.

As the releasing group of a two-equivalent 5-pyrazolone series coupler, the nitrogen atom releasing group described in U.S. Pat. No. 4,310,619 and the arylthio group described in U.S. Pat. No. 4,351,897 are particularly preferred. Also, the 5-pyrazolone series couplers having a ballast group described in European Patent 73,636 give a high coloring density.

As the pyrazoloazole series couplers, there are pyrazolobenzimidazoles described in U.S. Pat. No. 3,379,899, preferably pyrazolo[5,1-c][1,2,4]triazoles described in U.S. Pat. No. 3,725,067, pyrazolotetrazoles described in *Research Disclosure*, No. 24220 (Jun., 1984), and pyrazolopyrazoles described in *Research Disclosure*, No. 24230 (Jun., 1984). Also from the view point of less yellow side adsorption and light fastness of colored dyes, the imidazo[1,2-b]pyrazoles described in European Patent 119,741 are preferred and the pyrazolo[1,5-b][1,2,4]triazoles described in European Patent 119,860 are particularly preferred.

As the cyan coupler which can be used in this invention, there are oil protect type naphtholic or phenolic couplers. Typical naphtholic couplers are the naphtholic couplers described in U.S. Pat. No. 2,474,293 and preferably the oxygen atom releasing type two-equivalent naphtholic couplers described in U.S. Pat. Nos. 4,052,212, 4,146,396, 4,228,233, and 4,296,200.

Also, practical examples of the phenolic couplers are described in U.S. Pat. Nos. 2,369,929, 2,801,171, 2,772,162 and 2,895,826.

Cyan couplers fast to humidity and temperature can be preferably used in this invention. Typical examples thereof are phenolic cyan couplers having an alkyl group having 2 or more carbon atoms at the meta-position of the phenol nucleus described in U.S. Pat. No. 3,772,002, 2,5-diacylamino-substituted phenolic couplers, and phenolic couplers having a phenylureido group at the 2-position and an acylamino group at the 5-position.

For correcting an unnecessary absorption in a short wave length region of the dyes formed from a magenta coupler and a cyan coupler, it is preferred to use colored couplers for the color photographic light-sensitive material for in camera use.

In this invention graininess can be improved by using a coupler giving a colored dye having a proper diffusibility together with other couplers. Such dye diffusible couplers are described in U.S. Pat. No. 4,366,237 and British Patent 2,125,570, particularly with respect to the magenta coupler. Practical examples of the yellow, magenta and cyan couplers are described in European Patent 96,570 and West German Patent Publication (OLS) 3,234,533.

The dye-forming couplers and the aforesaid specific couplers may form dimers or more polymers. Practical examples of the polymerized dye-forming couplers are described in U.S. Pat. Nos. 3,451,820 and 4,080,211, and practical examples of the polymerized magenta coupler are described in British Patent 2,102,173 and U.S. Pat. No. 4,367,282.

Various couplers for use in this invention can be used in the same photosensitive emulsion layer as a mixture of two or more kinds thereof for providing the properties required for the photographic light-sensitive material, or the same kind of coupler can be contained in two or more emulsion layers.

The standard amount of the color coupler is from 0.001 to 1 mol per mol of light-sensitive silver halide, and preferably from 0.01 to 0.5 mol for a yellow coupler, from 0.003 to 0.3 mol for a magenta coupler, and from 0.002 to 0.3 mol for a cyan coupler.

In this invention, a developing agent such as a hydroxybenzene (e.g., hydroquinones), an aminophenol, a 3-pyraozolidone, etc., may be incorporated in the silver halide emulsion layer(s) or other hydrophilic colloid layer(s).

The silver halide photographic emulsions for use in this invention can be used for forming desired transferred images on an image-receiving layer after proper development process by combining with color image-providing compounds (coloring materials) for color diffusion transfer process capable of releasing diffusible dyes corresponding to the development of silver halide.

Many such coloring materials for color diffusion transfer process are known and in these materials, coloring materials of the type which is initially non-diffusible but releases a diffusible dye by being cleaved by the oxidation reduction reaction with the oxidation product of a developing agent (or an electron transferring agent)(hereinafter, the coloring material is referred to as DRR compound) are preferably used. In these materials, DRR compounds having an N-substituted sulfamoyl group are preferred. In particular, the DRR compounds having an o-hydroxyarylsulfamoyl group described in U.S. Pat. Nos. 4,055,428, 4,053,312, and 4,336,322 and the DRR compounds having a redox mother nucleus as described in JP-A-53-149328 are preferred in use together with the nucleating agent for use in this invention. When such a DRR compound is used together with the nucleating agent, the temperature reliance at processing is remarkably less.

It is preferred that after imagewise exposing the photographic light-sensitive material of this invention, after or while application of a fogging treatment with light or a nucleating agent to the light-sensitive material, the light-sensitive material is color developed with a surface developer containing an aromatic primary amino color developing agent and having pH of lower than 11.5 followed by bleaching and fixing or blixing to form a direct positive color image. It is more preferred that the pH of the color developer is in the range of from 11.0 to 10.0.

The fogging treatment in this invention is a so-called "light-fogging method" of applying a second light exposure to the whole surface of the photosensitive layer or a so-called "chemically fogging method" of processing in the presence of a nucleating agent. The fogging treatment may be practiced by developing in the presence of a nucleating agent and fogging light. Furthermore, a photographic light-sensitive material containing a nucleating agent may be subjected to a fogging exposure.

The light fogging method is described in Japanese Patent Application No. Sho-61-253716 (corresponding to JP-A-63-108336) page 47 line 4 to page 49 line 5, and the nucleating agents which can be used in this invention are also described in the aforesaid specification (page 49 line 6 to page 67 line 2) and in particular, the use of the compounds shown by formulae [N-1] and [N-2] described in the specification are preferred. Practical examples of these compounds are the compounds shown by [N-I-1] to [N-I-10] and [N-II-1] to [N-II-12] described in the specification (pages 56 to 58).

The nucleation accelerators which can be used in this invention are described at page 68 line 11 to page 71 line 3 the aforesaid Japanese Patent Application No. Sho-61-253716 and in particular, the nucleation accelerators shown by (A-1) to (A-13) described on pages 69 to 70 are preferable.

The color developer which is used for developing the photographic light-sensitive material of this invention is also described at page 71 line 4 to page 72 line 9 of the aforesaid Japanese Patent Application No. Sho-61-253716. In particular, the aromatic primary amino color developing agent is preferably a p-phenylenediamine series compound and typical examples thereof are 3-methyl-4-amino-N-ethyl-N-(β-methanesulfonamidoethyl)aniline, 3-methyl-4-amino-N-ethyl-N-(8-hydroxyethyl)aniline, 3-methyl-4-amino-N-ethyl-N-methoxyethylaniline and the salts such as sulfates and hydrochlorides of them.

For forming a direct positive color image by a color diffusion transfer process using the photographic light-sensitive material of this invention, a black-and-white developing agent such as a phenidone derivative can be used in place of the aforesaid color developing agent.

After color development, the photographic emulsion layer(s) are usually bleached. The bleach treatment may be performed simultaneously with a fix treatment (blix) or may be performed separately from the latter.

Furthermore, for quickening processing, a blix treatment may be applied after bleaching or a blix treatment may be applied after fixing.

In the bleach solution or the blix solution for use in this invention, an aminopolycarboxylic acid iron complex salt is usually used as a bleaching agent.

The bleach solution of blix solution for use in this invention may contain various additives as described on pages 22 to 30 of Japanese Patent Application No. Sho-61-32462 (corresponding to JP-A-62-215272).

After a desilvering step (blix or fix), a wash step and/or a stabilization step is applied. For wash water or the stabilization solution, water subjected to a water softening treatment is preferably used. For water softening is a method of using an ion exchange resin or a reverse osmosis apparatus described in JP-A-288838. A practical method thereof is also described in the same specification.

Furthermore, as an additive for wash water and the stabilization solution, various compounds described in JP-A-62-215272 can be used.

The amount of the replenisher for each processing step is preferably as little as possible. The amount of the replenisher is preferably from 0.1 to 50 times, and more preferably from 3 to 30 times the amount carried from the pre-bath per unit area of the light-sensitive material.

The invention is now explained practically by the following examples.

EXAMPLE 1

To an aqueous gelatin solution kept at 55° C. were added an aqueous silver nitrate solution and an aqueous halide solution for 60 minutes by a controlled double jet method to prepare a cubic monodisperse silver iodobromide emulsion having a mean grain size of 0.32 μm (coefficient of variation 12%, silver iodide 0.5 mol %, uniform iodine distribution). During the preparation of the emulsion, $K_3IrCl_6$ was added to the aqueous halide solution and was uniformly distributed in the silver halide grains at $5\times10^{-7}$ mol/mol-Ag.

The silver halide emulsion was desalted by a flocculation method and thereafter, $5\times10^{-4}$ mol (per mol of silver) of the sensitizing dye shown below and $1\times10^{-3}$ mol (per mol of silver) of an aqueous potassium iodide solution were added to the emulsion. Then, the emulsion was allowed to stand for 15 minutes and after adding thereto 4-hydroxy-5-methyl-1,3,3a,7-tetraazaindene, the temperature was allowed to lower, whereby Emulsion A was obtained.

Sensitizing Dye

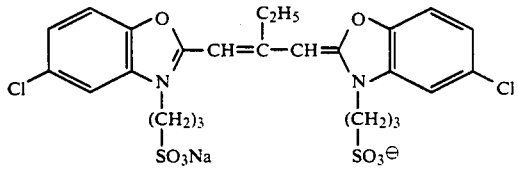

To the emulsion were added the hydrazine compounds shown in Table 1 below and then $2\times10^{-4}$ mol/mol-Ag of the following nucleation accelerator-A and $8.6\times10^{-3}$ mol/mol-Ag of 5-methylbenzotriazole were added. Nucleation accelerator-A:

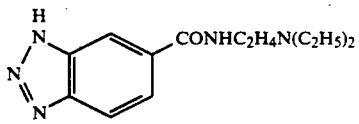

Then, after further adding thereto polyethyl acrylate and a hardening agent, 1,3-divinyl-sulfonyl-2-propanol, the emulsion was coated on a polyethylene terephthalate film at a silver coverage of 4.0 g/m². In this case, a layer containing 1.2 g/m² of gelatin, 40 mg/m² of an amorphous $SiO_2$ matting agent having a mean grain size of about 3 μm, 0.1 g/m² of methanol silica, the fluorine surface active agent shown by the following formula

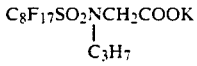

as a coating aid, and sodium dodecylbenzenesulfonate were simultaneously formed on the emulsion layer as a protective layer.

Also, a back layer having the following composition was coated.

| Back Layer Composition | |
|---|---|
| Gelatin | 4 g/m² |
| Matting agent: Polymethyl methacrylate (grain sizes 3.0–4.0 μm) | 10 mg/m² |
| Latex: Polyethyl acrylate | 2 g/m² |
| Surface active agent: Sodium p-dodecylbenzenesulfonate | 40 mg/m² |
| Fluorine series surface active agent: $C_8F_{17}SO_2N(C_3H_7)CH_2COOK$ | 5 mg/m² |
| Gelatin hardening agent: $(CH_2{=}CHSO_2CH_2CONH)_2(CH_2)_2$ | 110 mg/m² |
| Mixture of Dyes [a], [b], and [c] | |
| Dye [a] | 50 mg/m² |
| Dye [b] | 100 mg/m² |
| Dye [c] | 50 mg/m² |

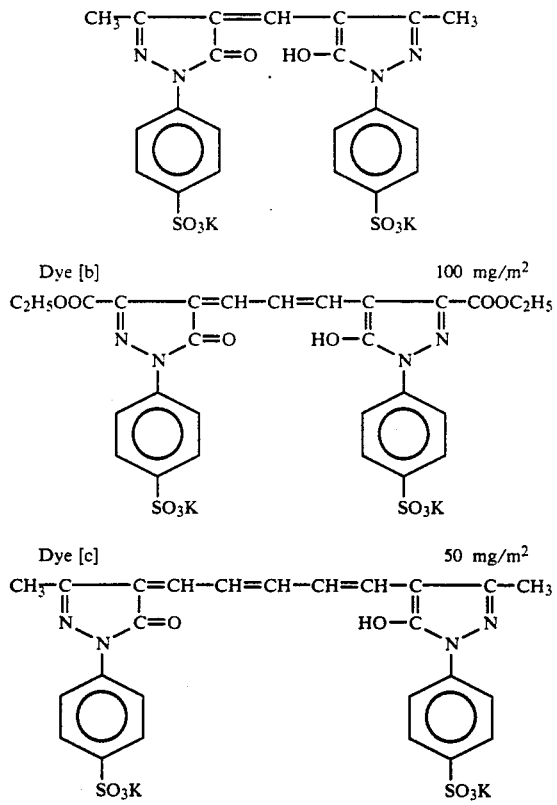

Each of the samples thus prepared was exposed to a tungsten light of 3200° K through an optical wedge or an optical wedge and a contact screen (150 L chain dot tube, made by Fuji Photo Film Co., Ltd.), developed by Developer-I shown below for 30 seconds at 34° C., fixed, washed, and dried. The fix solution was GRAN- DEX Fix Solution GF-F1, trade name, made by Fuji Photo Film Co., Ltd.

The sensitivity, gradation, and dot image quality of each sample obtained were shown in Table 1 below.

| Developer-I | |
|---|---|
| Hydroquinone | 54 g |
| 4-Methyl-4-hydroxymethyl-1-phenyl-pyrazolidone | 0.42 g |
| Potassium sulfite | 90 g |
| Ethylenediaminetetraacetic acid Disodium | 2.8 g |
| Potassium bromide | 5 g |
| 2-Mercaptobenzimidazole-5-sulfonic acid | 0.5 g |
| Boric acid (pH adjusted to 10.6 with potassium hydroxide) | 10 g |
| Water to make | 1 liter |

The dot gradation was shown by the following formula.
Dot gradation = Exposure amount (logE 95%) giving dot area ratio of 95% − exposure amount (logE 5%) giving dot area ratio of 5%.

Dot image quality was visually evaluated in five grades, wherein [5] showed the best quality and [1] the worst quality. As a dot master plate for plate making, grades [5] and [4] were practically usable, grade [3] was the practically usable crytical level, and grades [2] and [1] were practically unusable quality.

From the results shown in Table 1 below, it can be seen that in the case of using the comparison nucleating agent A, the dot gradation width is narrow, in the case of using the comparison nucleating agent B, the dot quality is insufficient. On the other hand, in the case of using the nucleating agents for use in this invention, dot quality is good in all cases.

TABLE 1

| | Nucleating Agent | | Photographic Characteristics | | |
|---|---|---|---|---|---|
| Sample | Kind | Amount mol/mol-Ag | Gradation ($\bar{G}$) | Dot Quality | Dot Gradation (R) |
| Comparison-a | A | $2.0 \times 10^{-3}$ | 8.5 | 4 | 1.20 |
| Comparison-b | B | " | 7.3 | 3 | 1.31 |
| Example 1-1 | Ia-2 | " | 8.5 | 4 | 1.35 |
| Example 1-2 | Ia-3 | " | 10.2 | 5 | 1.38 |
| Example 1-3 | Ia-5 | " | 9.3 | 4 | 1.38 |
| Example 1-4 | Ia-12 | " | 9.0 | 4 | 1.36 |
| Example 1-5 | Ia-4 | $4.0 \times 10^{-4}$ | 17.2 | 5 | 1.33 |
| Example 1-6 | Ia-6 | " | 12.6 | 5 | 1.34 |
| Example 1-7 | Ia-7 | " | 13.9 | 5 | 1.33 |
| Example 1-8 | Ib-2 | $2.0 \times 10^{-3}$ | 8.0 | 4 | 1.32 |
| Example 1-9 | Ib-8 | " | 7.4 | 4 | 1.35 |
| Example 1-10 | Ib-9 | " | 7.6 | 4 | 1.35 |
| Example 1-11 | Ib-3 | $4.0 \times 10^{-4}$ | 9.7 | 4 | 1.33 |
| Example 1-12 | Ib-12 | " | 9.5 | 4 | 1.38 |
| Example 1-13 | Ic-2 | $2.0 \times 10^{-3}$ | 8.5 | 4 | 1.33 |
| Example 1-14 | Ic-3 | " | 7.5 | 4 | 1.35 |
| Example 1-15 | Ic-5 | " | 7.3 | 4 | 1.36 |
| Example 1-16 | Ic-9 | $1.0 \times 10^{-3}$ | 9.2 | 5 | 1.35 |
| Example 1-17 | Ic-12 | $4.0 \times 10^{-4}$ | 15.1 | 5 | 1.38 |
| Example 1-18 | Ic-14 | " | 12.6 | 5 | 1.34 |
| Example 1-19 | Ic-15 | " | 14.8 | 5 | 1.33 |

Nucleating agents A and B are those described in European Patent 345025A.

A

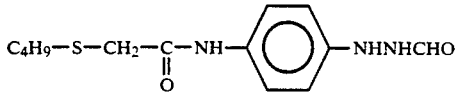

-continued

B

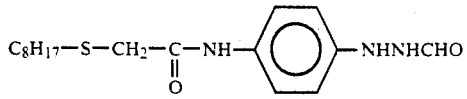

EXAMPLE 2

To an aqueous gelatin solution kept at 50° C. were simultaneously added an aqueous silver nitrate solution and an aqueous sodium chloride solution in the presence of $(NH_4)_3RhCl_6$ in an amount of $5.0 \times 10^{-5}$ mol per mol of silver and after removing soluble salts by a method well known in the art, gelatin was added to the mixture. Then, without applying chemical ripening, 2-methyl-4-hydroxy-1,3,3a,7-tetraazaindene was added thereto as a stabilizer. The emulsion thus obtained (Emulsion B) was a monodisperse silver halide emulsion of cubic crystal silver halide form having a mean grain size of 0.15 μm.

To Emulsion B were added each of the hydrazine compounds shown in Table 2. Then $2.0 \times 10^{-4}$ mol/mol-Ag of Nucleation Accelerator-A and a polyethyl acrylate latex (30% by weight as solid component to gelatin) were added to the emulsion, and then 1,3-vinylsulfonyl-2-propanol was added thereto as a hardening agent in an amount of 2.0% by weight to gelatin.

On the emulsion layer was coated a layer containing 1.5 g/m² of gelatin, 0.3 g/m² of polymethyl methacrylate particles (mean particle size 2.5 μm) as a matting agent, the surface active agents shown below as coating aid, the stabilizer shown below, and the ultraviolet absorptive dye shown below as a protective layer and dried.

Surface Active Agents

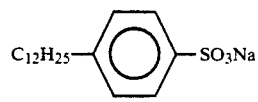

37 mg/m²

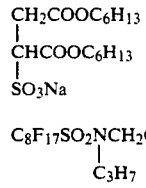

37 mg/m²

2.5 mg/m²

Stabilizer

Thioctic acid 2.1 mg/m²

Ultraviolet absorptive dye 100 mg/m²

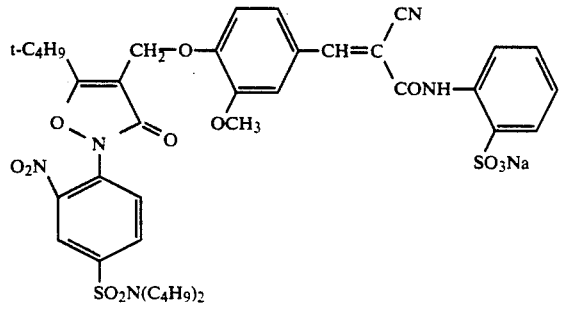

Figure 1B:
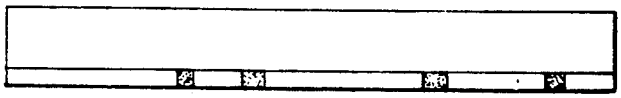
Figure 1C:
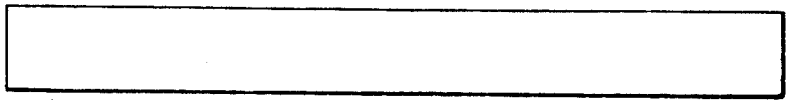
Figure 1D:
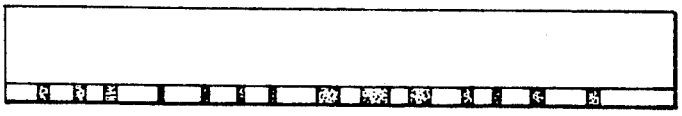
Figure 1E:
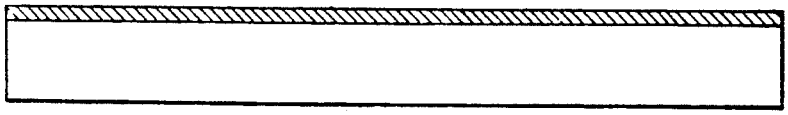

Each of the samples was imagewise exposed through an original shown in FIG. 1 using a bright room Printer P-607, trade name, made by Dainippon Screen Mfg. Co., Ltd., developed by Developer -II shown below for 20 seconds at 38° C., fixed, washed, and dried.

| Developer-II | |
|---|---|
| Hydroquinone | 50.0 g |
| N-Methyl-p-aminophenol | 0.3 g |
| Sodium hydroxide | 18.0 g |
| 5-Sulfosalicyclic acid | 55.0 g |
| Potassium sulfite | 110.0 g |
| Ethylenediaminetetraacetic acid disodium | 1.0 g |
| Potassium bromide | 10.0 g |
| 5-Methylbenzotriazole | 0.4 g |
| 2-Mercaptobenzimidazole-5-sulfonic acid | 0.3 g |
| Sodium 3-(5-mercaptotetrazole)-benzenesulfonate | 0.2 g |
| N-n-Butyldiethanolamine | 15.0 g |
| Sodium toluenesulfonate | 8.0 g |
| Water to make | 1 liter |

pH adjusted to 11.6 with potassium hydroxide.

Then, the quality of white lettering on solid background was evaluated. The image quality 5 of white lettering on solid background is the image quality of reproducing a letter of 30 μm in width when the original shown in FIG. 1 is adequately exposing onto a light sensitive material for contact work such that 50% dot area become 50% dot area on the light-sensitive material. On the other hand, the image quality 1 of white lettering on solid background is the image quality capable of reproducing a letter of above 150 μm in width only when the similar adequate exposure was applied. Ranks 4 to 2 are rated between 5 and 1 by a functional evaluation. Rank 3 or higher is a practically usable level.

The results obtained are shown in Table 2.

From the results, it can be seen that the samples of this invention are excellent in the image quality of white lettering on solid background and show high Dmax, contrast to the results obtained using nucleating agents A and C.

TABLE 2

| | Nucleating Agent | | Photographic Property | |
|---|---|---|---|---|
| Sample | Kind | Amount mol/mol-Ag | Image Quality of Lettering on Solid Background | Dmax |
| Comparison c | A | $4.0 \times 10^{-3}$ | 3 | 2.95 |
| Comparison d | C | " | 2 | 2.10 |
| Example 2-1 | Ia-3 | " | 5 | 4.08 |
| Example 2-2 | Ia-5 | " | 4 | 3.56 |
| Example 2-3 | Ia-4 | $8.0 \times 10^{-4}$ | 5 | 4.70 |
| Example 2-4 | Ia-6 | " | 4 | 4.15 |
| Example 2-5 | Ia-7 | " | 5 | 4.41 |
| Example 2-6 | Ib-2 | $4.0 \times 10^{-3}$ | 4 | 3.31 |
| Example 2-7 | Ib-8 | " | 4 | 3.25 |
| Example 2-8 | Ib-9 | " | 4 | 3.20 |
| Example 2-9 | Ib-3 | $8.0 \times 10^{-4}$ | 4 | 3.73 |
| Example 2-10 | Ib-12 | " | 4 | 3.82 |
| Example 2-11 | Ic-2 | $4.0 \times 10^{-3}$ | 4 | 3.51 |
| Example 2-12 | Ic-3 | " | 4 | 3.77 |
| Example 2-13 | Ic-12 | $8.0 \times 10^{-4}$ | 5 | 4.18 |
| Example 2-14 | Ic-14 | " | 5 | 4.05 |
| Example 2-15 | Ic-15 | " | 5 | 4.35 |

The nucleating agent C is the nucleating agent described in European Patent 345025A.

C:

-continued

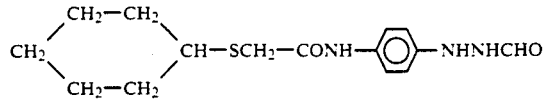

While the invention has been described in detail and with reference to specific embodiments thereof, it will be apparent to one skilled in the art that various changes and modifications can be made therein without departing from the spirit and scope thereof.

What is claimed is:

1. A silver halide photographic material having at least one silver halide photographic emulsion layer on a support, wherein the silver halide photographic emulsion layer or at least one other hydrophilic colloid layer contains at least one compound represented by formula (I*a*), (I*b*) or (I*c*):

$$R_{11}SCH_2CONH-Y_{11}-\overset{\overset{A_{11}}{|}}{N}-\overset{\overset{A_{12}}{|}}{N}-G_{11}-R_{12} \quad \text{(Ia)}$$

wherein $R_{11}$ represents an aliphatic group or an aromatic group, $R_{12}$ represents an alkyl group, an aryl group, an alkoxy group, an aryloxy group, an amino group, a hydrazino group, a carbamoyl group, or an oxycarbonyl group, $G_{11}$ represents $$-\overset{\overset{O}{\|}}{C}-,\ -SO_2-,\ -SO-,\ -\overset{\overset{O}{\|}}{\underset{\underset{R_{12}}{|}}{P}}-,$$

a thiocarbonyl group, or an iminomethylene group, $A_{11}$ and $A_{12}$ both represent a hydrogen atom, or one of them represents a hydrogen atom and the other represents a sulfonyl group or an acyl group, and $Y_{11}$ represents a divalent organic group which is an aliphatic group, an aromatic group, a heterocyclic group, or a group shown by following formula (d):

$$-Y_1'-\left(\underset{\underset{R_o^1}{|}}{C}=\underset{\underset{R_o^2}{|}}{C}\right)_r-\left(\underset{\underset{R_o^3}{|}}{C}=\underset{\underset{R_o^4}{|}}{C}\right)_s \quad \text{(d)}$$

wherein $Y'_1$ represents an aromatic group or a heterocyclic group, $R_o^1$ to $R_o^4$ each represents a hydrogen atom, a halogen atom, or an alkyl group, and r and s each represents 0 or 1;

$$R_{21}SCH_2CONH-Y_{21}-\overset{\overset{A_{11}}{|}}{N}-\overset{\overset{A_{12}}{|}}{N}-\overset{\overset{O}{\|}}{C}-H \quad \text{(Ib)}$$

wherein $R_{21}$ represents an aliphatic group, $Y_{21}$ represents a divalent heterocyclic group, and $A_{11}$ and $A_{12}$ have the same meaning as in formula (I*a*); and $$R_{31}SCH_2CONH-Y_{11}-\overset{\overset{A_{11}}{|}}{N}-\overset{\overset{A_{12}}{|}}{N}-\overset{\overset{O}{\|}}{C}-H \quad \text{(Ic)}$$

wherein $R_{31}$ represents an aromatic group, and $A_{11}$, $A_{12}$, and $Y_{11}$ have the same meaning as in formula (I*a*).

2. The silver halide photographic material of claim 1, wherein said at least one compound is represented by formula (Ia).

3. The silver halide photographic material of claim 1, wherein said at least one compound is represented by formula (Ib).

4. The silver halide photographic material of claim 1, wherein said at least one compound is represented by formula (Ic).

5. The silver halide photographic material of claim 4, wherein $Y_{11}$ in formula (Ic) is a substituted or unsubstituted p-phenylene group.

6. The silver halide photographic material of claim 1, wherein one of $R_{11}$, $R_{12}$ and $Y_{11}$, one of $R_{21}$ and $Y_{21}$, and one of $R_{31}$ and $Y_{11}$ are substituted by groups which are capable of promoting adsorption of the compounds represented by formula (Ia), (Ib) and (Ic) to the silver halide grain surfaces.

7. The silver halide photographic material of claim 1, wherein $R_{12}$ in formula (Ia) is a group represented by the following formula (a):

$$-R_{13}Z_{11} \qquad (a)$$

wherein $Z_{11}$ represents a group capable of splitting the moiety of $G_{11}$—$R_{13}$—$Z_{11}$ from the remaining molecule by attacking nucleophilically $G_{11}$, and $R_{13}$ is a group formed by removing one hydrogen atom from $R_{12}$, and wherein a cyclic structure is formed with $G_{11}$, $R_{13}$, and $Z_{11}$ upon nucleophilical attacking of $Z_{11}$ to $G_{11}$.

8. The silver halide photographic material of claim 7, wherein $R_{12}$ in formula (Ia) is a group represented by the following formula (b):

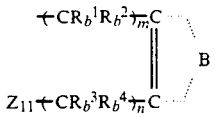

(b)

wherein $R_b^1$, $R_b^2$, $R_b^3$, and $R_6^4$ each represents a hydrogen atom, an alkyl group, an alkenyl group, or an aryl group, and they may be the same or different, B represents an atomic group necessary for forming a 5- or 6-membered ring which may have a substituent, and m and n each represents 0 or 1, n+m being 1 or 2.

9. The silver halide photographic material of claim 7, wherein $R_{12}$ in formula (Ia) is a group represented by the following formula (c):

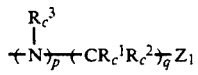

(c)

wherein $R_c^1$ and $R_c^2$, which may be the same or different, each represents a hydrogen atom, an alkyl group, an alkenyl group, an aryl group, or a halogen atom, $R_c^3$ represents a hydrogen atom, an alkyl group, an alkenyl group, or an aryl group, p represents 0, 1 or 2, and q represents an integer from 1 to 4.

10. The silver halide photographic material of claim 1, wherein said at least one compound is contained in an amount of from $1\times10^{-6}$ to $5\times10^{-2}$ mole per mol of silver halide.

11. The silver halide photographic material of claim 1, wherein said silver halide photographic emulsion layer is a negative working silver halide emulsion layer.

12. The silver halide photographic material of claim 1, wherein said silver halide photographic emulsion layer is an internal latent image type halide emulsion layer.

* * * * *